US009093741B1

(12) United States Patent
Weller et al.

(10) Patent No.: US 9,093,741 B1
(45) Date of Patent: Jul. 28, 2015

(54) COMPACT REPEATERS FOR WIRELESS SENSING

(71) Applicants: Thomas McCrea Weller, Lutz, FL (US); Ibrahim Turki Nassar, Tampa, FL (US); Jeffrey Frolik, Essex Junction, VT (US)

(72) Inventors: Thomas McCrea Weller, Lutz, FL (US); Ibrahim Turki Nassar, Tampa, FL (US); Jeffrey Frolik, Essex Junction, VT (US)

(73) Assignees: University of South Florida, Tampa, FL (US); University of Vermont and State Agricultural College, Burlington, VT (US)

( * ) Notice: Subject to any disclaimer, the term of this patent is extended or adjusted under 35 U.S.C. 154(b) by 0 days.

(21) Appl. No.: 14/222,139

(22) Filed: Mar. 21, 2014

Related U.S. Application Data

(63) Continuation of application No. 14/073,256, filed on Nov. 6, 2013.

(60) Provisional application No. 61/758,545, filed on Jan. 30, 2013.

(51) Int. Cl.

| | |
|---|---|
| ***H01Q 9/28*** | (2006.01) |
| ***H01Q 9/06*** | (2006.01) |
| ***H01Q 21/00*** | (2006.01) |
| ***H01Q 9/18*** | (2006.01) |

(52) U.S. Cl.
CPC ..... *H01Q 9/065* (2013.01); *H01Q 9/18* (2013.01); *H01Q 21/00* (2013.01)

(58) Field of Classification Search
CPC ..... H01Q 9/065; H01Q 9/16
USPC ..... 343/793–795
See application file for complete search history.

(56) References Cited

U.S. PATENT DOCUMENTS

| | | | | |
|---|---|---|---|---|
| 6,008,773 | A * | 12/1999 | Matsuoka et al. | 343/818 |
| 6,480,157 | B1 * | 11/2002 | Palmer et al. | 343/700 MS |
| 6,812,824 | B1 | 11/2004 | Goldinger | |
| 7,764,236 | B2 * | 7/2010 | Hill et al. | 343/702 |
| 7,783,250 | B2 * | 8/2010 | Lynch | 455/7 |
| 8,068,068 | B2 * | 11/2011 | Kish et al. | 343/876 |
| 2009/0286470 | A1 | 11/2009 | Mohammadian | |
| 2012/0155344 | A1 | 6/2012 | Wiley | |

OTHER PUBLICATIONS

B. Todd, M. Phillips, S. Schultz, A. Hawkins, and B. Jensen, "Low-cost RFID threshold shock sensors," IEEE Sensors J., vol. 9, No. 4, pp. 464-469, Apr. 2009.

Lopez-Higuera, et al., "Fiber Optic Sensors in Structural Health Monitoring", Journal of Lightwave Technology, vol. 29, No. 4, Feb. 15, 2011.

Pozar, "Microwave Engineering," Third Edidtion, John Wiley & Sons, Inc. New Jersey, Cha. 13, pp. 98-106, 2005.

S. Aguilar, and T. Weller, "Tunable harmonic re-radiator for sensing applications," IEEE MTT-S Int. Microw. Symp Dig., pp. 1565-1568, Jun. 2009.

(Continued)

*Primary Examiner* — Dameon E Levi
*Assistant Examiner* — Hasan Islam
(74) *Attorney, Agent, or Firm* — Thomas | Horstemeyer, LLP

(57) ABSTRACT

In one embodiment, a repeater for wireless sensing includes a base substrate, a front substrate, a rear substrate, a receive antenna formed on the front substrate, a transmit antenna formed on the rear substrate, and a frequency multiplier formed on the base substrate between the antennas.

20 Claims, 17 Drawing Sheets

(56) References Cited

OTHER PUBLICATIONS

A. Ali Babar, L. Ukkonen, L. Sydanheimo, "Dual UHF RFID band miniaturized multipurpose planar antenna for compact wireless systems," Int. Workshop on Antenna Tech. (iWAT), pp. 1-4. Mar. 2010.
A. Bereketli and O. Akan, "Communication coverage in wireless passive sensor networks," IEEE Commun. Lett., vol. 13, No. 3, pp. 133-135, Feb. 2009.
S. R. Best, "Low Q electrically small linear and elliptical polarized spherical dipole antennas," IEEE Trans. Antennas Propag., vol. 53, No. 3, pp. 1047-1053, Mar. 2005.
R. Bhuiyan, R. Dougal, and M. Ali, "A miniature energy harvesting device for wireless sensors in electric power system," IEEE Sensors J., vol. 10, No. 7, pp. 1249-1258, Jul. 2010.
M. Bouthinon, J. Gavan, and F. Zadworny, "Passive microwave transposer, frequency doubler for detecting the avalanche victims," IEEE European Microw. Conf., pp. 579-583, Sep. 8-12, 1980.
J. Caicedo, J. Marulanda, P. Thomson, and S. Dyke, "Monitoring of bridges to detect changes in structural health," Proceedings of the 2001 American Control Conf., Arlington, Virginia, Jun. 2001.
X. Chen, K. Church, and H. Yang, "High speed non-contact printing for solar cell front side metallization," IEEE Photovoltaic Specialists Conf., pp. 001343-001347, Jun. 2010.
J. Chin, J. Rautenberg, C. Ma, S. Pujol, and D. Yau, "An experimental low-cost, low-data-rate rapid structural assessment network," IEEE Sensors J., vol. 10, No. 7, pp. 1361-1369, Jul. 2010.
K. Chintalapudi et al., "Monitoring civil structures with a wireless sensor network," IEEE Internet Computing, vol. 10, No. 2, pp. 26-34, Mar. 2006.
B. Colpitts and G. Boiteau, "Harmonic radar transceiver design: Miniature tags for insect tracking," IEEE Trans. Antennas Propag., vol. 52, No. 11, pp. 2825-2832, Nov. 2004.
B. Cook, A. Shamim, and M. Tentzeris, "Passive low-cost inkjet-printed smart skin sensor for structural health monitoring," IET Microw. Antennas Propag., vol. 6, No. 14, pp. 1536-1541, Nov. 2012.
J. Czyzewski, P. Burzynski, K. Gawel, and J. Meisner, "Rapid prototyping of electrically conductive components using 3D printing technology," J. Materials Processing Tech., vol. 209, Issue 12-13, pp. 5281-5285, Jul. 2009.
A. Deivasigamani, A. Daliri, C. Wang, and S John, "A review of passive wireless sensors for structural health monitoring" Modern applied Science, vol. 7, No. 2, 2013.
J. Gao, J. J Siden, and H. Nilsson, "Printed electromagnetic coupler with an embedded moisture sensor for ordinary passive RFID tags," IEEE Electron Device Lett., vol. 32, No. 12, pp. 1767-1769, Dec. 2011.
J. Gao; Gao. J. Siden, H. Nilsson, and M. Gulliksson, "Printed humidity sensor with memory functionality for passive RFID tags," IEEE Sensors J., vol. 13, No. 5, pp. 1824-1834, May 2013.
J. Heidemann and R. Govindan, "Embedded sensor networks," USC—Information and computer Sciences Institute, 2004.
J. Hines, "Review of recent passive wireless SAW sensor and sensor-tag activity," IEEE Fly by Wirel. Workshop, 2011 4th Annual Caneus, pp. 1-2, Jun. 2011.
Girbau, A. Ramos, A. Lazaro, S. Rima, and R. Villarino, "Passive\ wireless temperature sensor based on time-coded UWB chipless RFID tags," IEEE Trans. Microw. Theory Techn., vol. 60, No. 11, pp. 3623-3632, Nov. 2012.
G. Grazzini, M. Pieraccini, D. Dei, and C. Atzeni, "Simple microwave sensor for remote detection of structural vibration," Electronics Lett., vol. 45, No. 11, pp. 567-569, May 2009.
S. Jabir and N. Gupta, "Thick-film ceramic strain sensors for structural health monitoring," IEEE Trans. Instrum. Meas., vol. 60, No. 11, pp. 3669-3676, Nov. 2011.
C. M. Kruesi, R. J. Vyas, and M. M. Tentzeris, "Design and development of a novel 3-D cubic antenna for wireless sensor networks (WSNs) and RFID applications," IEEE Trans. Antennas Propag., vol. 57, No. 10, pp. 3293-3299, Oct. 2009.
C. Hartmann, L. Claiborne, "Fundamental limitations on reading range of passive IC-based RFID and SAW-based RFID," IEEE Int. Conf. RFID, pp. 41-48, Mar. 2007.
D. Liao and K. Sarabandi, "Optimization of low-profile antennas for applications in unattended ground sensor networks," IEEE Antennas Propag. Soc. Int. Symp., pp. 783-786, Jul. 2006.
C. Lin and Y. Yang, "Use of a passing vehicle to scan the fundamental bridge frequencies: An experimental verification," Eng. Struct., vol. 27, No. 13, pp. 1865-1878, 2005.
S. Kim, S. Pakzad, D. Culler, G. Fenves, S. Glaser, and M. Turon, "Health monitoring of civil infrastructures using wireless sensor networks." IEEE Int. Conf. Inf. Process. Sensor Net., Apr. 2007.
I. Nassar and T. Weller "Development of Novel 3-D Cube Antennas for Compact Wireless Sensor Nodes," IEEE Trans. Antennas and Propagation, vol. 60, No. 2, pp. 1059-1065, Feb. 2012.
I. Nassar, T. Weller, and J. Frolik "A Compact 3-D Harmonic Repeater for Passive Wireless Sensing," IEE transactions on Microwave Theory and Techniques, vol. 60, No. 10, Oct. 2012.
I. Nassar and T. Weller, "Design and characterization of a passive harmonic sensor embedded in sand," IEEE Wireless Microw. Tech. Conf., to be published.
I. Nassar and T. Weller, "An electrically-small, 3-D cube antenna fabricated with additive manufacturing" IEEE Radio Wireless Symp., pp. 262-264, Jan. 2013.
I. Nassar, T. Weller, J. Wang, "A High-Efficiency, Miniaturized Sensor Node with Machined- Substrate Antennas for Embedded Wireless Monitoring," IEEE Center for Wireless and Microwave Information Systems, 2013.
B. Nath, F. Reynolds, and R. Want, "RFID technology and applications," IEEE Pervasive Computing, vol. 5, No. 1, pp. 22-24, Jan. 2006.
J. Ong, Z. You, J. Mills-Beale, E. Tan, B. Pereles, and K. Ong, "A wireless, passive embedded sensor for real-time monitoring of water content in civil engineering materials," IEEE Sensors J., vol. 8, No. 12, pp. 2053-2058, Dec. 2008.
V. Plessky and L. Reindl, "Review on SAW RFID tags," IEEE Trans. Ultrason. Ferroelect. Freq. Contr., vol. 57, No. 3, pp. 654-668, Mar. 2010.
S. Presas, T. Weller, S. Silverman, and M. Rakijas, "High efficiency diode doubler with conjugate-matched antennas," IEEE European Microw. Conf., pp. 250-253, Oct. 2007.
D. Psychoudakis, W. Moulder, C.-C. Chen, H. Zhu, and J. Volakis, "A portable low-power harmonic radar system and conformal tag for insect tracking," IEEE Antennas Wirel. Propag. Lett., vol. 7, pp. 444-447, 2008.
E. Sazonov, H. Li, D. Curry, and P. Pillay, "Self-powered sensors for monitoring of highway bridges," IEEE Sensors J., vol. 9, No. 11, pp. 1422-1429, Nov. 2009.
S. Spiekermann and S. Evdokimov, "Critical RFID privacy-enhancing technologies," IEEE Security Privacy, vol. 7, No. 2, pp. 56-62, Mar. 2009.
S. Sudevalayam and P. Kulkarni,"Energy harvesting sensor nodes: survey and implications," IEEE Commun. Surv. Tut., vol. 13, No. 3, pp. 443-461, Third Quarter 2011.
Z. Tsai et al., "A high-range-accuracy and high-sensitivity harmonic radar using pulse pseudorandom code for bee searching," IEEE Trans. Microw. Theory Techn., vol. 61, No. 1, pp. 666-675, Jan. 2013.
V. Viikari and H. Seppa, "RFID MEMS sensor concept based on intermodulation distortion," IEEE Sens. Jour., vol. 9, No. 12, pp. 1918-1923, Dec. 2009.
V. Viikari, H. Seppa, and D.-W. Kim, "Intermodulation read-out principle for passive wireless sensors," IEEE Trans. Microw. Theory Techn., vol. 59, No. 4, pp. 1025-1031, Apr. 2011.
J. Wardlaw, I. Karaman, and A. Karsilayan, "Low-power circuits and energy harvesting for structural health monitoring of bridges," IEEE Sensors Journal, vol. 13, No. 2, pp. 709-722, Feb. 2013.
T. Weller, J. Wang, I. Nassar, J. Dewney, R. Davidova, J. Frolik, and V. Sakamuri, "A Wireless interrogator—passive sensor approach for deeply embedded sensing applications," IEEE Antennas Propag. Soc. Int. Symp., pp. 1445-1448, Jul. 2011.
H. A. Wheeler, "The radiansphere around a small antenna," Proc. IRE, vol. 47, No. 8, pp. 1325-1331, Aug. 1959.

(56) References Cited

OTHER PUBLICATIONS

M. Whelan, M. Gangone, and K. Janoyan, "Highway bridge assessment using an adaptive real-time wireless sensor network," IEEE Sensors J., vol. 9, No. 11, pp. 1405-1413, Nov. 2009.
Y. Yang, C. Lin, and J. Yau, "Extracting bridge frequencies from the dynamic response of a passing vehicle," J. Sound Vibrat., vol. 272, Nos. 3-5, pp. 471-493, 2004.
Y. Yang and C. Lin, "Vehicle-bridge interaction dynamics and potential applications," J. Sound Vibrat., vol. 284, Nos. 1-2, pp. 205-226,2005.
F. Yu, K. Lyon, and E. Kan, "A novel passive RFID transponder using harmonic generation of nonlinear transmission lines," IEEE Trans. Microw. Theory Tech., vol. 58, No. 12, pp. 4121-4127, Dec. 2010.
X. Zhang and F.-Y. Wang, "Key technologies of passive wireless sensor networks based on surface acoustic wave resonators," IEEE Int. Conf. Networking, Sensing and Contr., pp. 1253-1258, Apr. 2008.
Wang, et al. "A Wireless Interrogator—Passive Sensor Approach for Deeply Embedded Sensing Applications", 2011 IEEE.
Weller, et al. "Small Antennas Design for 2.4 GHz Applications—Thesis" 2010, Graduate School Theses and Dissertations.
Park, et al. "A 0.38 THz Fully Integrated Transceiver Utilizing a Quadrature Push-Push Harmonic Circuitry in SiGe BiCMOS" IEEE Journal of Solid-State Circuits, vol. 47, No. 10, Oct. 2012.
Chang, et al. "An Ultra Low Phase Noise MMIC-Based 89-GHz Source Module", SPIE vol. 2842, Aug. 4, 1996.

* cited by examiner

| Antenna Iteration | Gain Variation (dB) | Efficiency (%) |
|---|---|---|
| Receive 1st | 0.5 | 66 |
| Transmit 1st | 9 | 75 |
| Receive 2nd | 0.4 | 71 |
| Transmit 2nd | 7 | 80 |
| Receive (Machined) | 0.3 | 84 |
| Transmit (Machined) | 3.2 | 93 |

FIG. 19

COMPACT REPEATERS FOR WIRELESS SENSING

CROSS-REFERENCE TO RELATED APPLICATION(S)

This application is a continuation of U.S. Non-Provisional Application entitled "Compact Repeaters For Wireless Sensing," having Ser. No. 14/073,256, filed Nov. 6, 2013, which claims priority to U.S. Provisional Application entitled "Compact Repeaters For Wireless Sensing", having Ser. No. 61/758,545, filed Jan. 30, 2012, both which are hereby incorporated by reference herein in their entirety.

NOTICE OF GOVERNMENT-SPONSORED RESEARCH

This invention was made with Government support under grant contract numbers ECCS-0925728 and ECCS-0925929 awarded by the National Science Foundation (NSF). The Government has certain rights in the invention.

BACKGROUND

In the last decade, environmental, industrial, and military monitoring applications have motivated research related to wireless sensing. Some applications, such as structural health monitoring, would benefit from sensing that is deeply embedded in the environment for an extended period of time. For such applications, it is desirable that the sensing device has an indefinite operating lifetime and a compact geometry for deployment ease and to ensure that the integrity of the structure being monitored is not compromised. The former constraint necessitates either that the sensing device has sufficient on-board energy resources to sustain an active device for the deployment lifetime or that the node be passive. For use in civil infrastructure, the approach of using an on-board energy resource may not be tenable. Because of this, there has been a large amount of recent work on passive wireless sensing systems.

In addition to on-board direct current (DC) power considerations, a passive device should require very low externally provided power for activation to ensure sufficient wireless transmission range. One approach for providing such power is through radio frequency (RF) interrogation. Both passive radio frequency identification (RFID) and surface acoustic wave (SAW) sensors operate on this premise. Unfortunately, such devices are typically constrained to short-range implementations, typically a few feet, because of their requisite activation power.

In view of the above discussion, it can be appreciated that it would be desirable to have a compact passive device for wireless sensing that requires relatively low externally provided power for activation and that provides sufficient wireless transmission range.

BRIEF DESCRIPTION OF THE DRAWINGS

The present disclosure may be better understood with reference to the following figures. Matching reference numerals designate corresponding parts throughout the figures, which are not necessarily drawn to scale.

FIG. 19 is a comparison table that illustrates the impact of machining substrates on the transceiver performance.

DETAILED DESCRIPTION

As described above, it would be desirable to have a compact passive device for wireless sensing that requires relatively low externally provided power for activation and that provides sufficient wireless transmission range. Disclosed herein are repeaters for wireless sensing applications. In some embodiments, the repeaters are harmonic repeaters that comprise a frequency multiplier and conjugate-matched three-dimensional receive and transmit antennas. In some embodiments, the repeaters are configured to receive an interrogation signal and re-radiate a return signal that has a frequency that is twice the frequency of the interrogation signal. The return signal can be modulated by a passive sensor to which the repeater is electrically coupled. In some embodiments, the repeater has a communication range of greater than approximately 50 m using a 2 W source in a free-space environment.

In the following disclosure, various specific embodiments are described. It is to be understood that those embodiments are example implementations of the disclosed inventions and that alternative embodiments are possible. All such embodiments are intended to fall within the scope of this disclosure.

As identified above, the disclosed repeaters comprise frequency multipliers. In some embodiments, the frequency multipliers are diode-based multipliers that re-radiate return signals having a frequency that is twice that of the incoming interrogation signal. In such a case, the repeater can be classified as a frequency doubling reflectenna (FDR).

Schottky barrier diodes are desirable in passive frequency multipliers because of their strong non-linear current-voltage characteristics. A GaAs Schottky diode can be used in developing an embodiment of an FDR. Such a diode has low signal loss at frequencies of interest and turns on at a very low induced voltage because of its low barrier junction.

The main parameter of interest in characterizing a multiplier design is the conversion gain (CG). The CG of a diode doubler is expressed as follows:

$$CG = P_{out}(\text{dBm}) - P_{in}(\text{dBm}) \quad \text{(Equation 1)}$$

where in this case $P_{out}$ is the output power of the multiplier at the second harmonic (e.g., 4.8 GHz) and $P_{in}$ is the input power at the fundamental frequency (e.g., 2.4 GHz).

Figure 1:
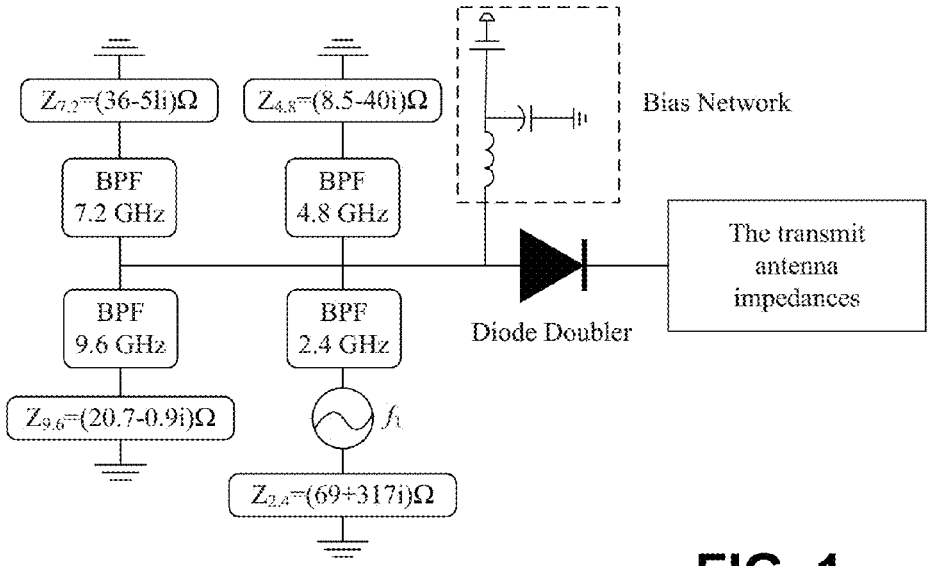
FIG. 1 is a schematic block diagram of an embodiment of a repeater.

A simulation was performed to predict a multiplier response using Agilent's Advanced Design System (ADS) software. FIG. 1 shows a schematic block diagram of a repeater that was evaluated in the simulation. The source shown in FIG. 1 represents the receive antenna and the load represents the transmit antenna. To deliver and collect maximum power to and from the diode, the antennas were designed to be conjugate-matched with the doubler input/output impedances. Because of the diode non-linearity, the power transfer conditions are dependent on the loads presented to the doubler at the fundamental and the harmonic frequencies. Therefore, to accurately predict the multiplier response, harmonic impedances up to the fourth order were accounted for in the simulation. The number of harmonics was limited because of the minimal performance difference at the fourth harmonic. To ensure that the appropriate impedance was represented at the source for each reflected harmonic, band-pass filters were utilized. The values of the antenna impedances at harmonic frequencies were extracted using Ansoft's High Frequency Structure Simulator (HFSS) version 11.

A DC bias connection was included in the frequency doubler design. The bias was supplied to the diode input through an 18 nH series inductor (Coilcraft 0402) and 8.2 pF shunt capacitor (Johanson 0201). The purpose of including the DC bias connection was to impart amplitude modulation on the retransmitted signal. In addition, this connection provided a DC return path on the input side of the diode. For the output side, the DC path was provided by a shunt stub that was added to the transmit antenna feeding network.

Figure 2A:
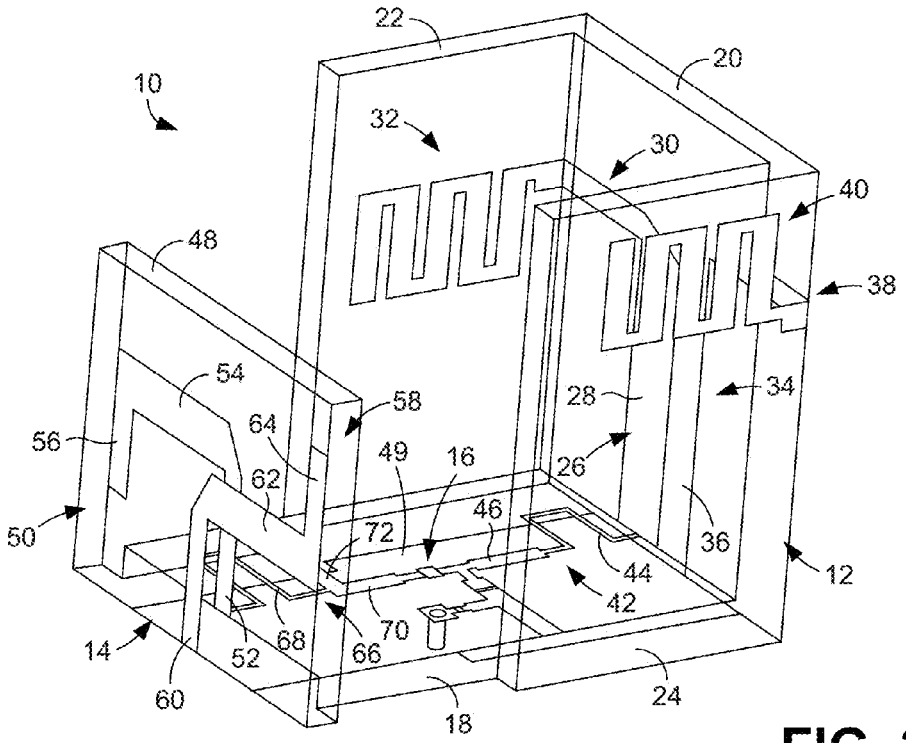
FIG. 2A is a perspective view of an embodiment of a repeater comprising a receive antenna, a transmit antenna, and a frequency multiplier.
Figure 2B:
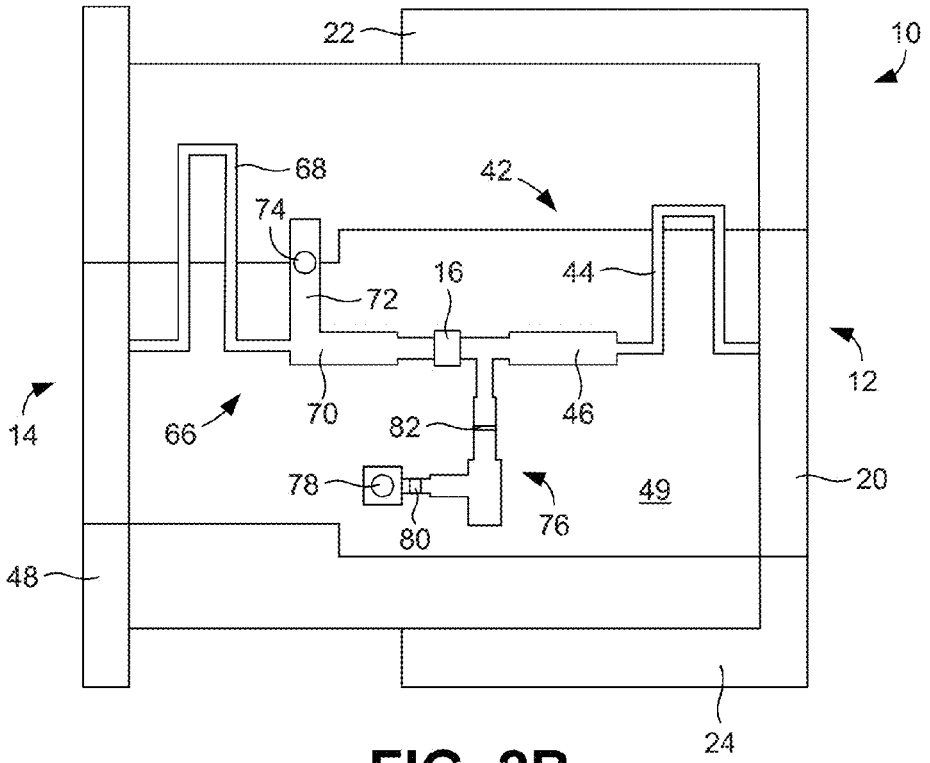
FIG. 2B is a top view of the repeater of FIG. 2A.
Figure 2C:
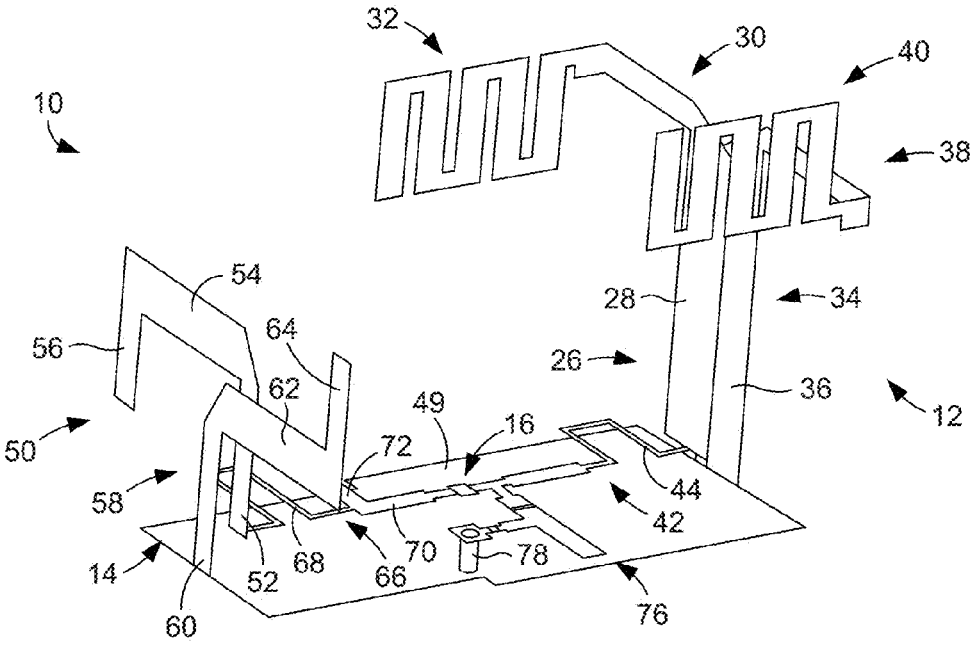
FIG. 2C is a further perspective view of the repeater of FIG. 2A without the repeater's substrates shown.

FIGS. 2A-2C illustrate an example embodiment of a repeater 10 that is configured as an FDR. More particularly, FIG. 2A shows the repeater 10 in a perspective view, FIG. 2B shows the repeater in a top (plan) view, and FIG. 2C shows the repeater in perspective view without its substrates shown to more clearly illustrate the configuration of the electrical components of the repeater. Generally speaking, the repeater 10 comprises a receive antenna 12 and a transmit antenna 14 that are coupled by a frequency multiplier 16, which can comprise a Schottky barrier diode.

The receive antenna 12 is a three-dimensional half-wave dipole antenna. In some embodiments, the antenna operates at 2.4 GHz. As shown in FIG. 2A, the receive antenna 12 is formed on multiple substrates that together form part of a cube structure of the repeater 10. In the illustrated embodiment, these substrates include a base substrate 18, a front substrate 20, and opposed first and second lateral substrates 22 and 24. Each of these substrates is orthogonal to the other substrates. In the orientation shown in FIG. 2A, the base substrate 18 is contained in a horizontal plane while the front substrate 20 and the lateral substrates 22, 24 are contained in separate vertical planes. Each substrate is composed of a dielectric material and comprises an inner surface that faces the interior of the cube and an outer surface that faces outward from the cube. By way of example, the substrates can be constructed of Rogers/RT Duroid 6010 material and have a nominal relative dielectric constant ($\in_r$) of 10.2 and a thickness of 50 mils (1.27 mm).

With reference to FIGS. 2A and 2C, the receive antenna 12 comprises two separate antenna elements that together form the dipole. A first antenna element 26 comprises a vertical portion 28 that extends upward from the base substrate 18 along the inner surface of the front substrate 20 and an arm 30 that extends laterally from a top end of the vertical portion. The arm 30 extends horizontally along the inner surfaces of both the front substrate 20 and the first lateral substrate 22. Provided at a distal end of the arm 30 on the inner surface of the first lateral substrate 22 is a meandered portion 32 that balances the current distribution across the dipole. As is shown in FIGS. 2A and 2C, the meandered portion 32 extends downward from the distal end of the arm 30.

The second antenna element 34 of the receive antenna 12 is anti-symmetrical to the first antenna element 26. As is shown in FIGS. 2A and 2C, the second antenna element 34 comprises a vertical portion 36 that extends upward from the base substrate 18 along the outer surface of the front substrate 20 (i.e., on the opposite side of the vertical portion 28 of the first antenna element 26). Together, the vertical portions 28, 36 of the first and second antenna elements 26, 34 form a parallel plate balun that balances a meandered microstrip matching line described below. The second antenna element 34 also comprises an arm 38 that extends outward from a top end of the vertical portion 36. That arm 38 extends horizontally along the outer surface of both the front substrate 20 and the second lateral substrate 24. Provided at a distal end of the arm 38 on the outer surface of the second lateral substrate 24 is a further meandered portion 40. As shown in FIGS. 2A and 2C, however, the meandered portion 40 of the second antenna element 34 extends upward from the distal end of the arm 38.

As is further shown in FIGS. 2A and 2C, the first antenna element 26 is coupled to a feeding network 42. As shown best in FIG. 2B, the feeding network 42 includes a meandered microstrip matching line 44 and a 50Ω microstrip line 46, which are both formed on the inner surface of the base substrate 18. The second antenna element 34 is coupled to a ground plane 49 that is formed on the outer (bottom) surface of the base substrate 18.

Figure 3A:
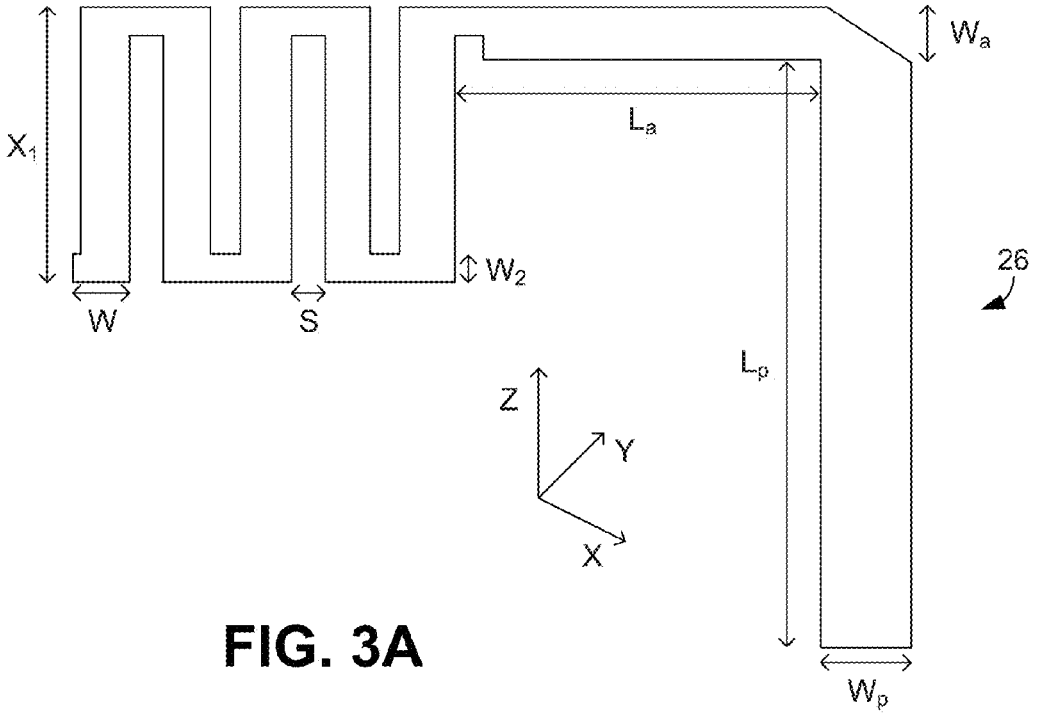
FIG. 3A is a schematic view of an antenna element of the receive antenna shown in FIGS. 2A and 2C.

Based on the diode doubler ADS simulation, the receive antenna 12 has an impedance of 69-F317i Ω at 2.4 GHz for maximum CG at −30 dBm input power. To match the antenna input impedance to this desired impedance, Ansoft HFSS 11 software was used to optimize parameters, such as the dimensions of the meandered portions 32, 40 of the antenna elements 26, 34, the width and length of the non-meandered sections of the antenna elements, the width of the parallel plate balun, the length of the 50Ω microstrip line 46, and the width and length of the microstrip matching line 44. Table I shows example 2.4 GHz receive antenna dimensions for variables illustrated in FIG. 3A, which illustrates the first antenna element 26.

TABLE I

| 2.4 GHz ANTENNA DIMENSIONS (mm) | | | |
|---|---|---|---|
| $L_a$ | 5.2 | $L_{50}$ | 3.0 |
| $W_a$ | 1.0 | $W_{50}$ | 0.8 |
| $L_p$ | 11.0 | $X_1$ | 4.0 |
| $W_p$ | 2.5 | W | 1.0 |
| S | 0.5 | $W_2$ | 1.3 |
| Ground Length | 8.27 | Ground Width | 10.0 |

Figure 4:
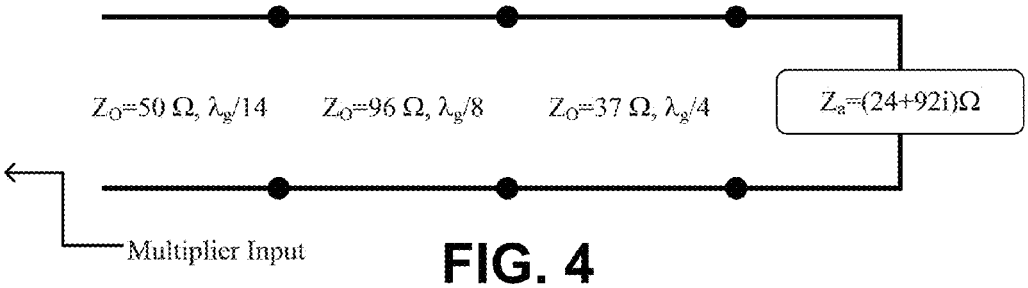
FIG. 4 is an equivalent circuit model for the receive antenna shown in FIGS. 2A and 2C.
Figure 5A:
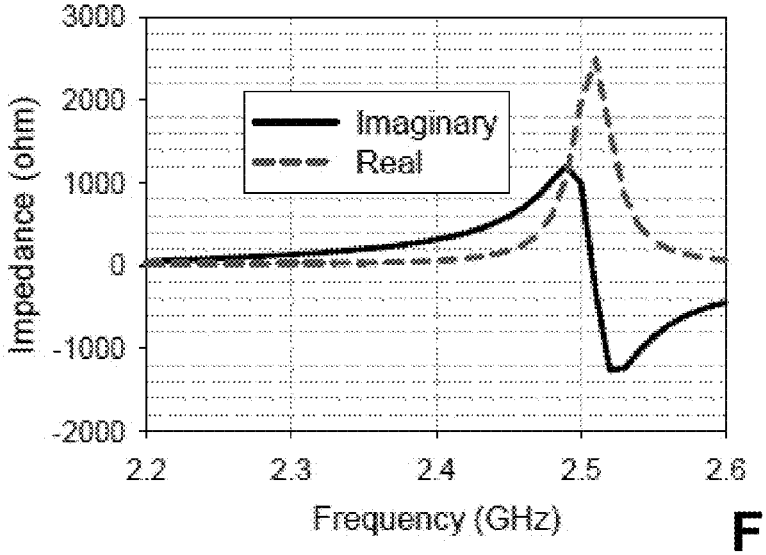
FIGS. 5A and 5B are graphs of the receive antenna input impedance (5A) and the reflection coefficient between the receive antenna and the doubler input at −30 dBm input power and 0 V bias (5B).
Figure 5B:
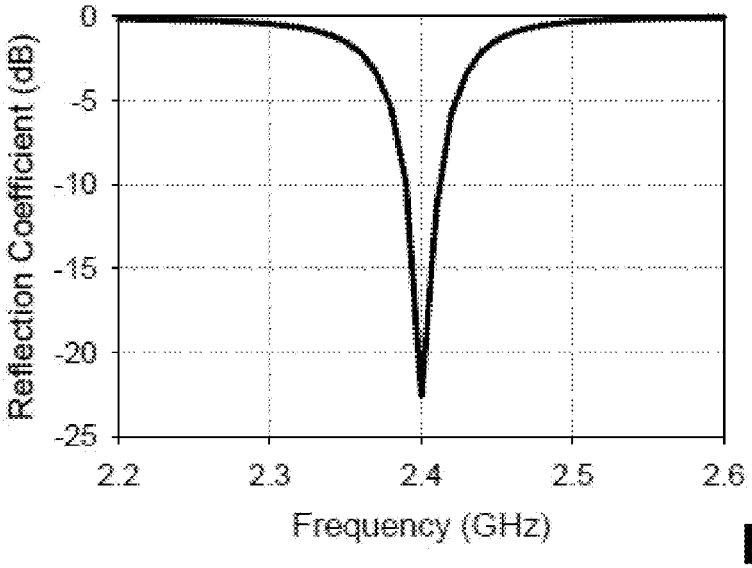

An approximate equivalent circuit model of the receive antenna 12 is illustrated in FIG. 4. In that figure, $Z_o$ is the characteristic impedance and $Z_a$ is the approximate antenna input impedance at 2.4 GHz. The characteristic impedances of the parallel plate transformer and the meandered matching line are 37Ω and 96Ω, respectively. The simulated 2.4 GHz antenna input impedance and the reflection coefficient between the 2.4 GHz antenna and the doubler input at −30 dBm input power are illustrated in FIGS. 5A and 5B. The input impedance at 2.4 GHz is 59-F315i Ω and the 10 dB return loss bandwidth is 1%. FIG. 5B shows that the reflected power at the fundamental frequency is very low. The reflection coefficient for RF input power ≤−20 dBm is approximately the same.

Figure 6:
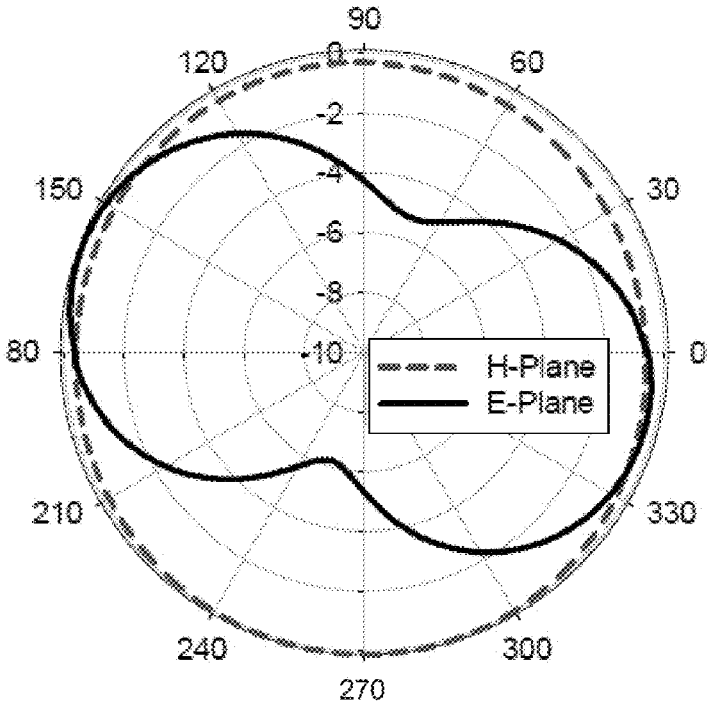
FIG. 6 is a graph of simulated radiation patterns (in dB) of a 2.4 GHz receive antenna.

FIG. 6 shows the simulated E- and H-plane radiation patterns of the receive antenna 12 at 2.4 GHz. Relative to the coordinate system shown in FIG. 3A, the H-plane is the Y-Z plane and the E-plane is the X-Y plane. The receive antenna 12 demonstrated an omni-directional pattern in the H-plane with only 0.8 dB variation. The maximum radiation occurred broadside to the non-meandered portions of the dipole arms 30, 38 with a peak gain of 0.5 dBi. The E-plane null was not as deep as a regular dipole antenna (only 6.8 dB) because of the incomplete cancellation of the radiated far-fields from the non-meandered sections of the dipole arms 30, 38. The tilt in the E-plane pattern was because of ground plane interference.

With reference back to FIGS. 2A and 2C, the transmit antenna 14 is also a three-dimensional half-wave dipole antenna. In some embodiments, the transmit antenna 14 operates at 4.8 GHz (i.e., double 2.4 GHz). The transmit antenna 14 is constructed on the base substrate 18 and a rear substrate 48, which are orthogonal to each other. In the orientation illustrated in FIGS. 2A and 2C, the rear substrate 48 is contained in a vertical plane. As with the other substrates, the rear substrate 48 is composed of a dielectric material (e.g., Rogers/RT Duroid 6010 material) and comprises an inner surface and an outer surface.

As shown in FIGS. 2A and 2C, the transmit antenna 14 also comprises first and second antenna elements that together form the dipole. A first antenna element 50 of the dipole comprises a vertical portion 52 that extends upward from the base substrate 18 along the inner surface of the rear substrate 48 and an arm 54 that extends laterally from a top end of the vertical portion. The arm 54 extends horizontally along the inner surface of the rear substrate 48 and terminates in a downwardly extending vertical portion 56. The second antenna element 58 is anti-symmetrical to the first antenna element 50. As is shown in FIGS. 2A and 2C, the second antenna element 58 comprises a vertical portion 60 that extends upward from the base substrate 18 along the outer surface of the rear substrate 48 and an arm 62 that extends laterally from a top end of the vertical portion. The arm 62 extends horizontally along the outer surface of the rear substrate 48 and terminates in an upwardly extending vertical portion 64. Together, the vertical portions 52, 60 of the first and second antenna elements 50, 58 form a parallel plate balun.

As is further shown in FIGS. 2A and 2C, the second antenna element 58 is coupled to the ground plane 49 that is formed on the outer surface of the base substrate 18, while the first antenna element 50 is coupled to a feeding network 66 that is formed on the inner surface of the base substrate. As shown best in FIG. 2B, the feeding network 66 includes a meandered microstrip matching line 68, a 50Ω microstrip line 70, and a shunt stub 72 that is positioned between the matching line and the microstrip line. The shunt stub 72 connects to the ground plane 49 with a via hole 74.

Figure 3B:
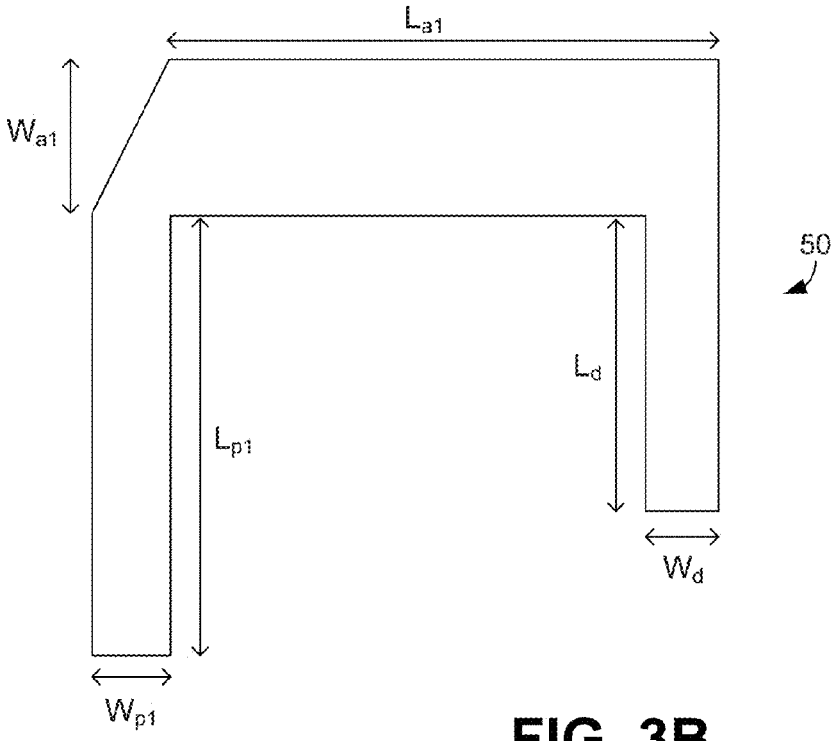
FIG. 3B is a schematic view of an antenna element of the transmit antenna shown in FIGS. 2A and 2C.
Figure 7:
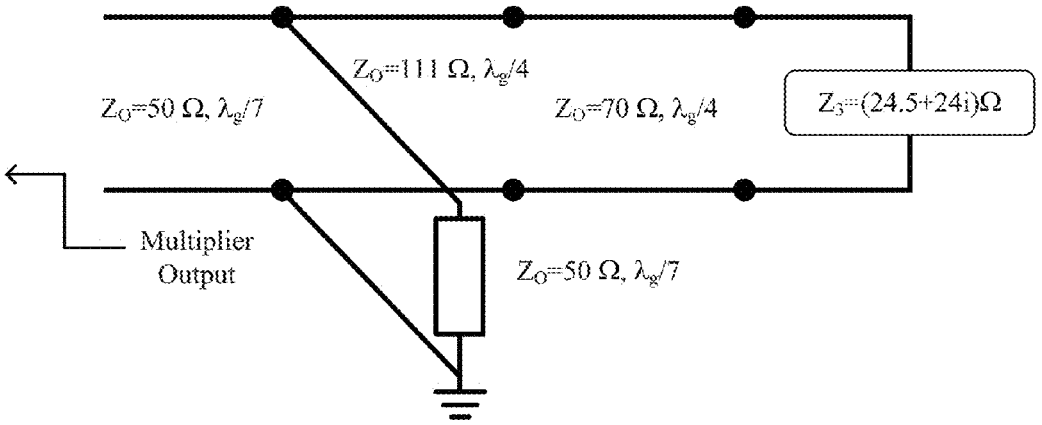
FIG. 7 is an equivalent circuit model for the transmit antenna shown in FIGS. 2A and 2C.

For optimal frequency conversion gain at −30 dBm input power, the ADS doubler simulation shows that the transmit antenna 14 should have an impedance of 15-F152i Ω at 4.8 GHz. This result was obtained from simulations of the transmit antenna 14 in the presence of the receive antenna 12. In order to match the 4.8 GHz antenna input impedance to the desired impedance, the width and length of the dipole arms 54, 62, parallel plate balun width, and the meandered matching line width and length were all optimized. In addition, the length and width of the shunt stub 72 were subsequently tuned. The shunt stub 72 was added to increase the reactive part of the input impedance and to give a DC return path to the diode doubler. The final approximate equivalent circuit model of the receive antenna is shown in FIG. 7. Table II shows example dimensions for the 4.8 GHz transmit antenna (variables identified in FIG. 3B, which illustrates the first antenna element 50).

TABLE II

| 4.8 GHz ANTENNA DIMENSIONS (mm) | | | | | |
|---|---|---|---|---|---|
| $L_{a1}$ | 5.2 | $L_{50}$ | 3.0 | $W_d$ | 1.0 |
| $W_{a1}$ | 1.8 | $W_{50}$ | 0.8 | $W_{p1}$ | 1.0 |
| $L_{p1}$ | 5.25 | $L_d$ | 3.5 | Via radius | 0.35 |
| Stub Length | | 3.0 | Stub Width | | 0.8 |
| Ground Length | | 8.77 | Ground Width | | 8.0 |

Figure 8A:
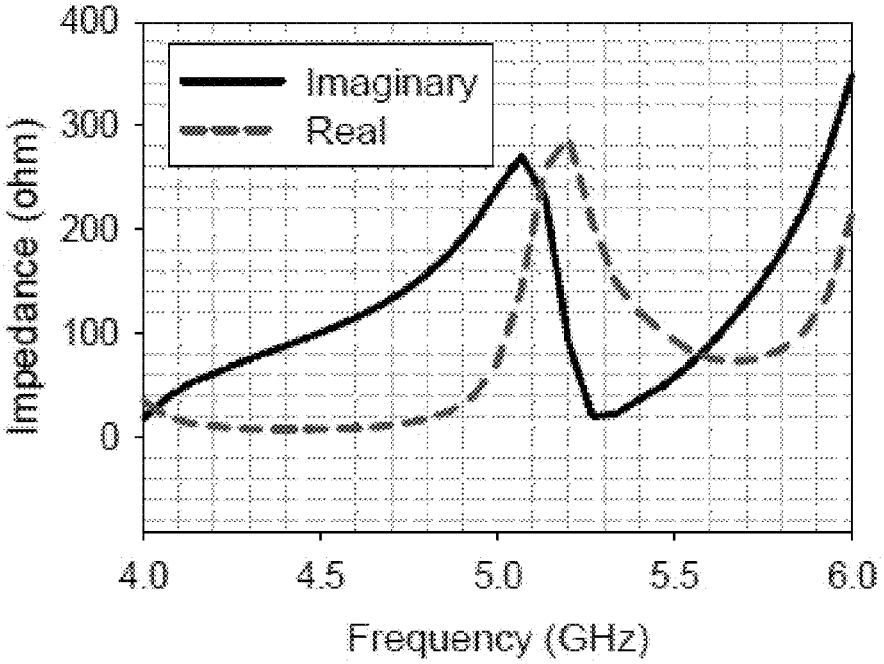
FIGS. 8A and 8B are graphs of the transmit antenna input impedance (l8A) and the reflection coefficient between the transmit antenna and the doubler output at −30 dBm input power and 0 V bias (8B).
Figure 8B:
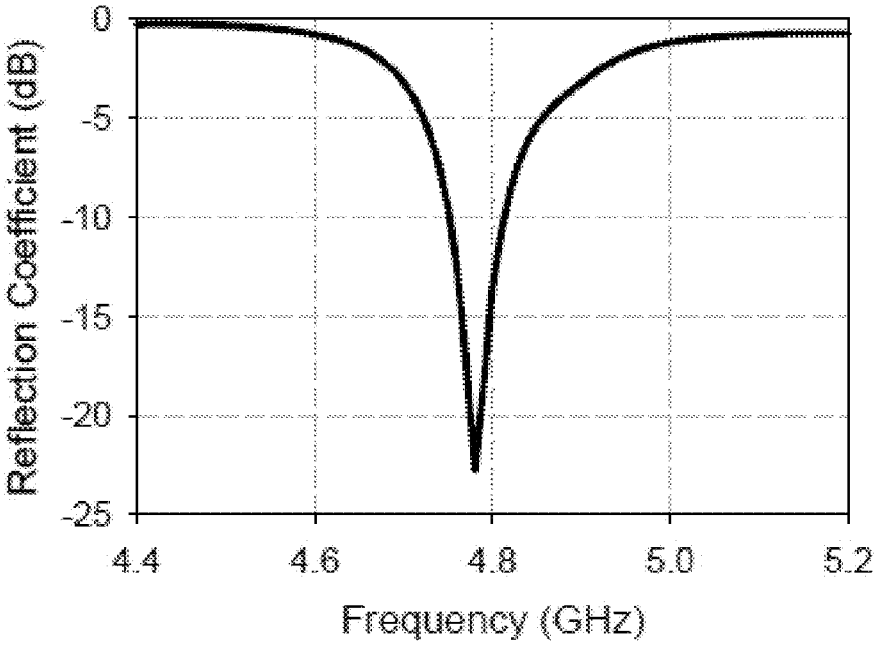
Figure 9:
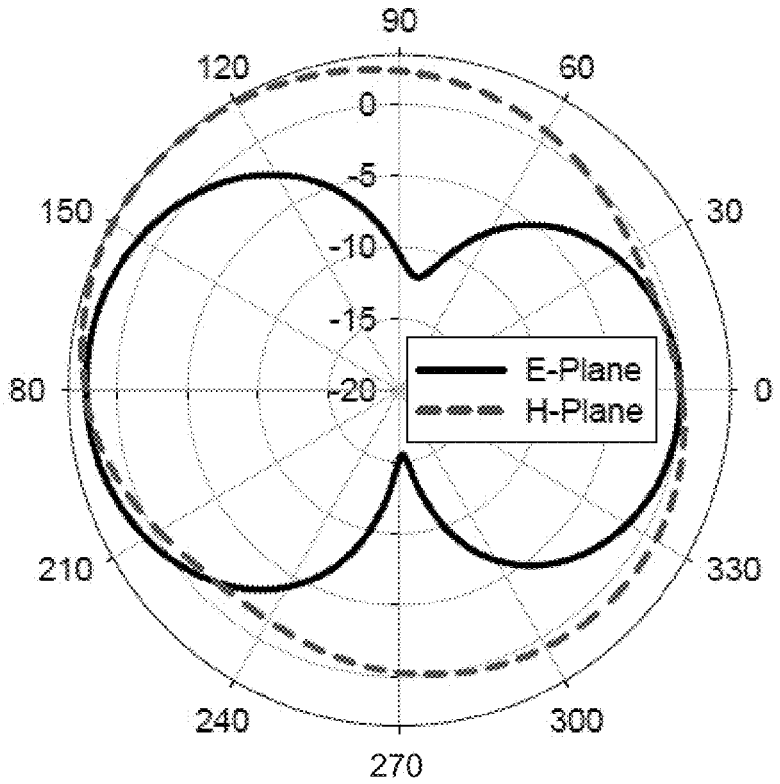
FIG. 9 is a graph of simulated radiation patterns (in dB) of a 4.8 GHz transmit antenna.

The simulated transmit antenna input impedance and the reflection coefficient between the transmit antenna input and the doubler output at −30 dBm are shown in FIGS. 8A and 8B. The 10 dB return loss bandwidth was 1.4% and the antenna input impedance at 4.8 GHz was 17.6-F156i Ω. FIG. 9 shows the simulated radiation patterns at 4.8 GHz. The transmit antenna 14 exhibited an omni-directional pattern in the H-plane with a variation of 4.5 dB and a peak gain of 3.4 dBi. The variation over the H-plane was because of the diffraction and reflection from the 2.4 GHz antenna substrate and ground plane 49. For the same reason, the peak gain was higher than a regular half-wave dipole because of the increase in the directivity.

With reference back to FIGS. 2A-2C, the repeater 10 also comprises a DC bias network 76 that is coupled to the feeding network 42 of the receive antenna 12. The bias network 76 can be used to connect a sensor to the repeater 10 so that the signal received by the repeater during interrogation can be modulated by the sensor to provide an indication of the sensed parameter (e.g., temperature, vibration, etc.). In the illustrated embodiment, the bias network includes a via hole 78 that connects to the ground plane 49, a capacitor 80, and an inductor 82.

Two prototype repeaters, designated FDR1 and FDR2, were fabricated for testing purposes. The repeaters were formed using a printed circuit board milling machine and were assembled manually. Silver epoxy was used to attach the diode and lumped components, and copper wire was used to create the via connections to the ground plane.

Measurements were performed inside an anechoic chamber where the FDRs received the transmitted $f_1$ signal, doubled the frequency, and re-radiated a $2f_1$ signal. A vector network analyzer (VNA) was used to send the transmitted signal and a spectrum analyzer (SA) was used for measuring the received signal power level. Path spreading loss was calculated using the Friis transmission equation. The measurements were executed over a 1 m distance and the FDR was oriented in the direction where the maximum CG was recorded. The two interrogator antennas (transmit and receive) were placed 1.3 m apart.

Figure 10:
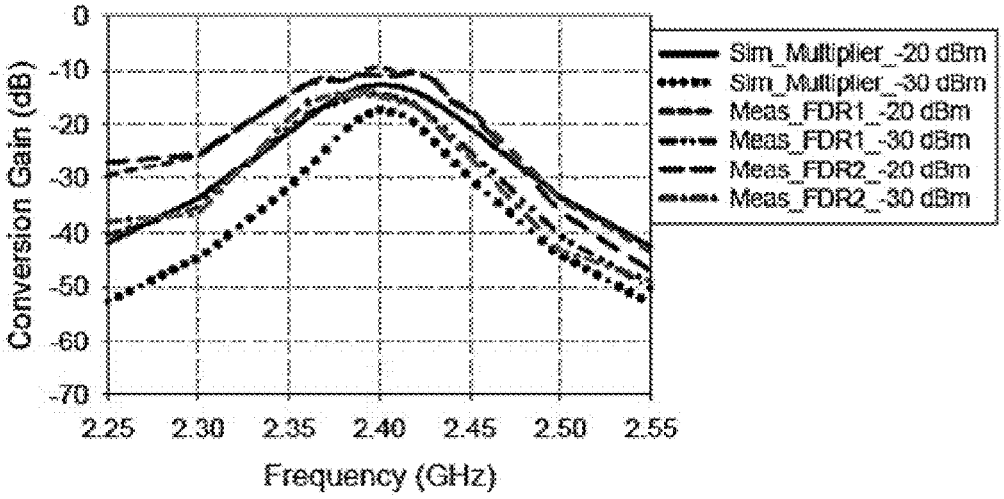
FIG. 10 is a graph of simulated and measured conversion gain versus frequency for different input powers at 0 V bias for a repeater prototype.

FIG. 10 shows the simulated conversion gain of the diode multiplier alone (excluding the antenna gains) and the measured CG of the entire FDR over frequency for different input powers and zero volt bias. The simulated 3 dB CG bandwidth was 2.5% and 1.7% at input powers of −20 dBm and −30 dBm, respectively. This CG bandwidth dependence on power was because of the power dependence of the diode impedance. The measured maximum CG was recorded at 2.4 GHz for both of the FDR prototypes. The measured CG peak value was −9.45 dB and −14 dB for FDR1, and −9.25 dB and −13.3 dB for FDR2 at RF input power levels of −20 dBm and −30 dBm, respectively. The measured 3 dB CG bandwidth for both of the FDRs at −20 dBm was approximately 3%, while it was approximately 2.5% at −30 dBm. The performance variation between the two FDRs is attributed to fabrication and assembly differences.

Figure 11:
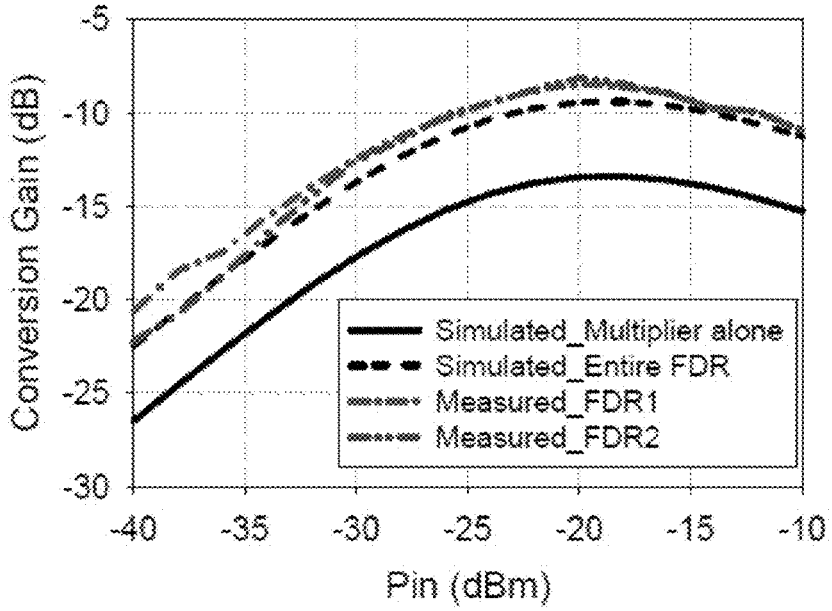
FIG. 11 is a graph of simulated and measured conversion gain versus input power at $f_1$ of 2.4 GHz and 0 V bias for a repeater prototype.

The CG versus input power at 2.4 GHz was measured for the two FDRs and was compared with the simulated data in FIG. 11. The simulated CG of the entire FDR was calculated by adding 4 dB (the sum of antenna gains) to the simulated CG curve of the multiplier alone. As can be appreciated from FIG. 11, the measured curves are well matched with the simulated curve and the two FDRs show similar performance.

Figure 12:
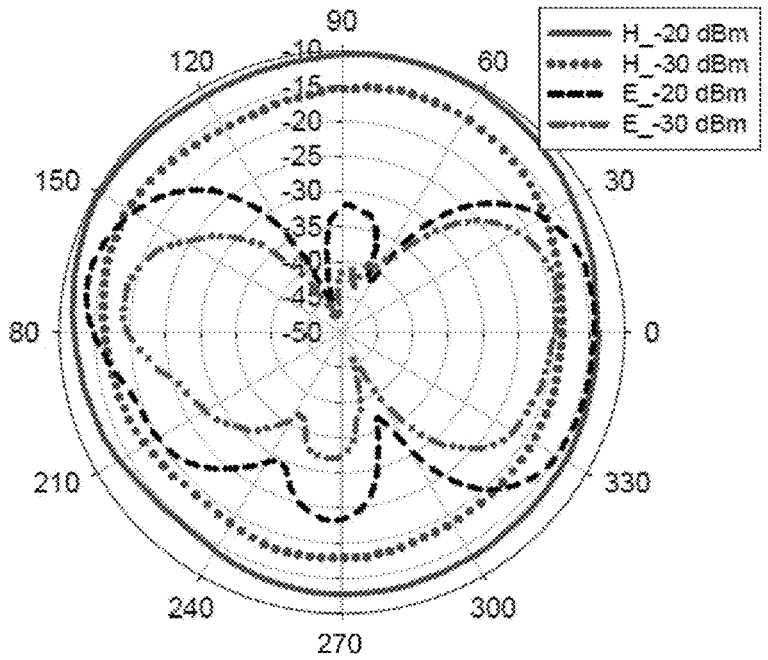
FIG. 12 is a graph of measured conversion gain (dB) versus incidence angle (Y-Z plane in FIG. 11) for different received power levels at $f_1$ of 2.4 GHz and 0 V bias for a repeater prototype.

FIG. 12 demonstrates the measured CG performance versus angle of incidence over the E- and H-plane radiation patterns of the receive and transmit antennas. The measurements were performed for FDR1. Relative to the coordinate system in FIG. 2, the H-plane is the Y-Z plane and the E-plane is the X-Z plane. The measurements were performed at $f_1$ of 2.4 GHz and zero volt bias. The measured variations in CG over the H-plane for received powers of −20 and −30 dBm were 4 and 5 dB, respectively. The CG variation dependence on the received power was expected, since the variation over the FDR receive antenna H-plane (0.8 dB) changed the received power level at the diode input, and the doubler has a non-linear CG relation with input power (FIG. 11). The measured cross-polarization isolation level, defined here as the ratio between the return signal levels from the FDR for co- and cross-polarized interrogation signals, was approximately 30 dB for both of the FDRs.

Figure 13:
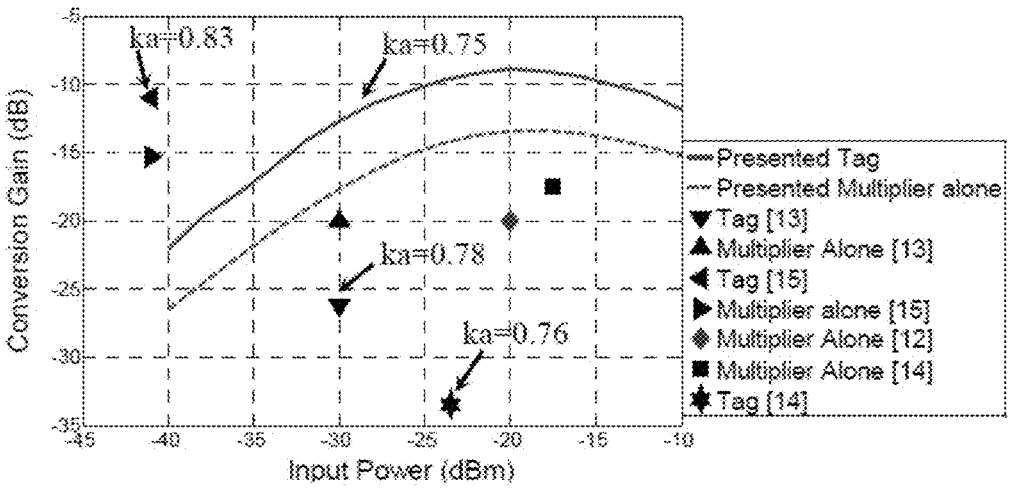
FIG. 13 is a graph that compares conversion gain and electrical size at $f_1$ of the disclosed embodiment and prior art embodiments.

The measured and simulated FDR parameters at $f_1$ of 2.4 GHz are listed in Table III. Good agreement was observed between the measured and predicted data. FIG. 13 shows a comparison of the CG at different operating power levels and the electrical size (ka) of the design presented in this work and others from the literature. Ka represents the size of the overall repeater structure including the feed network, substrate, and ground plane, where $k=2\pi/\lambda$, $\lambda$=free space wavelength at $f_1$, and a=radius of the smallest sphere enclosing the maximum dimension of the repeater. To make a fairer comparison, the conversion gain of the multiplier alone of some designs (excluding the antenna gains) is included. As can be appreciated from FIG. 13, the disclosed repeater shows better conversion gain than other designs having similar electrical size. This CG improvement is significant because it increases the detection range, which is needed for embedded, remote monitoring applications.

TABLE III

MEASURED AND SIMULATED FDR PARAMETERS

| Parameter | Measured FDR1 | Measured FDR2 | Simulated |
|---|---|---|---|
| CG at −20 dBm (dB) | −9.45 | −9.25 | −9.44 |
| CG at −30 dBm (dB) | −14.0 | −13.3 | −13.7 |
| 3 dB CG BW % at −20 dBm | 3.0 | 3.2 | 2.5 |
| 3 dB CG BW % at −30 dBm | 2.5 | 2.6 | 1.7 |

Figure 14:
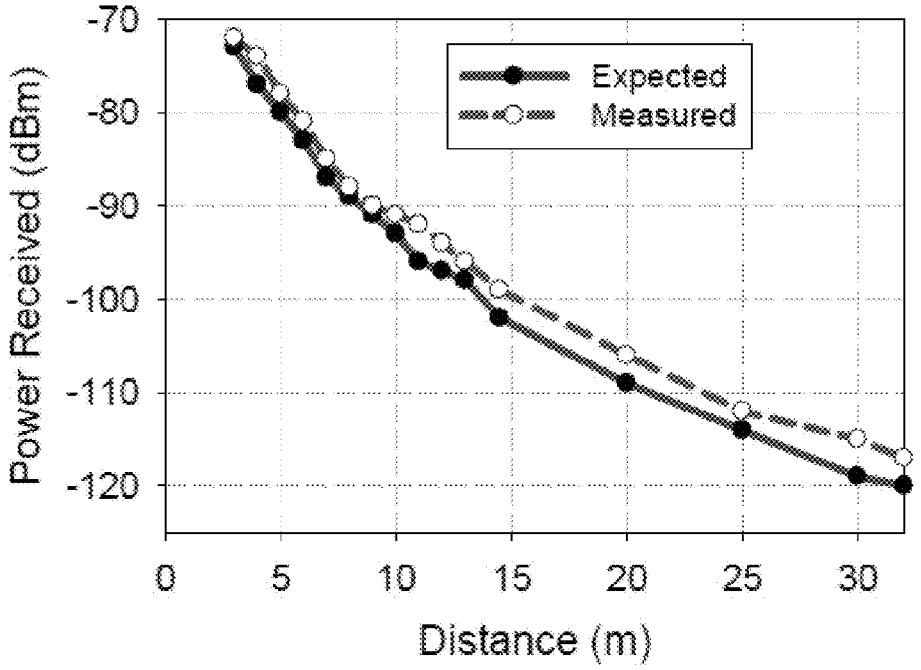
FIG. 14 is a graph of a received signal level versus distance at 0 V bias for a repeater prototype.

Outdoor measurements were performed to validate the FDR performance in a long-range, free-space environment. The return signal was measured as the FDR was moved to vary the distance from the interrogator, as shown in FIG. 14. The FDR and the two interrogator antennas were positioned 1.4 m above the ground. The measurement setup used was the same as the one described above. The FDR was oriented in the direction where the maximum CG was recorded (interrogated from the top, +Z-axis). The maximum available power from the interrogator transmit antenna was only 32 dBm, which resulted in a range of 32 m. The accuracy in the measurements was +/−1 dB. The expected power level was calculated based on the measured CG in the anechoic chamber using a 1 m interrogation distance (FIG. 11). As can be appreciated from FIG. 14, the measured and expected return signal strengths were well matched. The power received did not decay exponentially with increasing interrogation distance because of the non-linear CG behavior of the FDR versus received power. Using the same radar setup shown in FIG. 16 with a higher gain amplifier (>33 dB), a communication range greater than 50 m can be achieved. This range is calculated based on a received signal level of −120 dBm at the interrogator detection stage. When using a spectrum analyzer for signal detection, this power level provides approximately 15 dB headroom given a 10 kHz resolution bandwidth.

Figure 15:
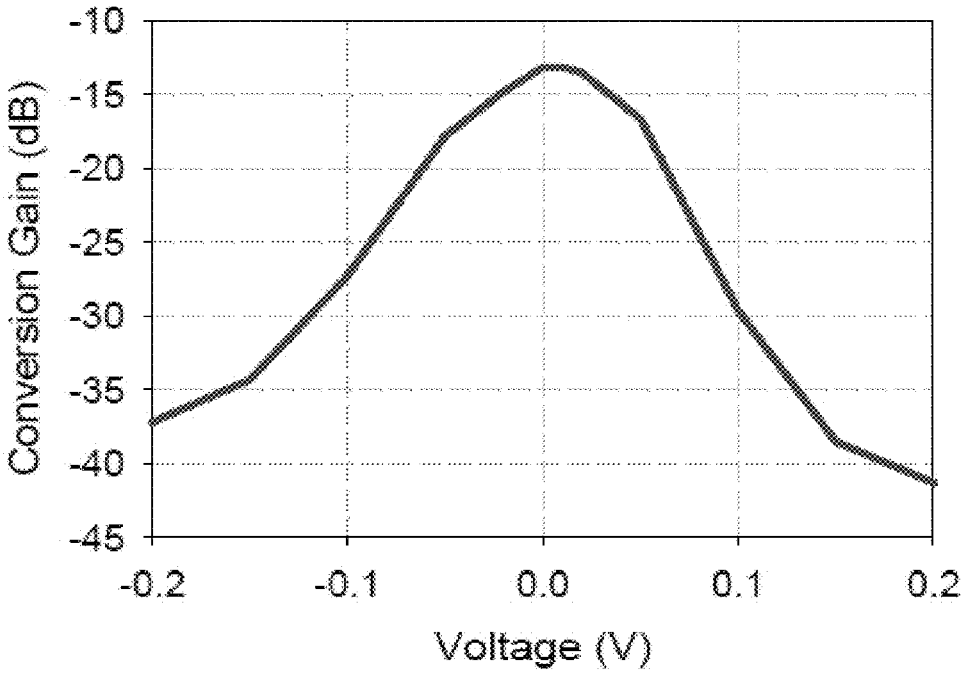
FIG. 15 is a graph of a measured conversion gain versus bias voltage at −30 dBm input power and $f_1$ of 2.4 GHz for a repeater prototype.

In order to facilitate the use of the FDR in a sensing application, the ability to modulate the return signal has been included. Using the DC network that connects to the diode input, a bias voltage can be applied to change the impedance match with the receive antenna causing a change in the CG and allowing for amplitude modulation of the re-transmitted signal from the transceiver. FIG. 15 demonstrates the CG behavior versus bias voltage at −30 dBm input power and 2.4 GHz incident frequency. As shown in that figure, the performance is sensitive to the applied bias voltage. A 0.1 V bias decreases the transmitted power by 17 dB. This sensitivity for small applied voltage would allow for amplitude modulation of the back-scattered signal.

As mentioned above, the three-dimensional approach provides the capability of housing the sensor electronics inside the structure. This requires that the FDR performance is insensitive to the insertion of objects (e.g. sensors) inside the cube. To demonstrate this, the FDR was tested with metallic and lossy dielectric ($\in_r$ of 10 and loss tangent of 0.1) blocks measuring 2×5×2 $mm^3$ placed inside on the bottom side of the cube. Experimental results show that the transceiver performance was not degraded with these blocks, which occupied a larger volume than many practical sensors.

The ability to calibrate the propagation channel between the interrogator and a remote sensor node, effectively determining the round-trip path loss absent sensor stimulus effects at the node, can be important for practical implementation of this passive sensing technology. Such calibration may be needed when the exact distance to the FDR or the characteristics of the embedding environment are unknown. In one embodiment, remote calibration can include the use of two, orthogonally polarized FDRs that are in close proximity and operate as a single unit. One of the FDRs has no local stimulus and is referred to as the reference node, while the second FDR operates as the sensing node and has the local stimulus (DC bias in this demonstration) connected to the diode multiplier. To minimize the coupling between the FDRs and distortion in their radiation patterns, one of the FDRs is placed in the radiation pattern null of the other. Through simulation and experimental testing it was found that a separation distance of 8 mm between the nodes resulted in minimal change in the performance of either FDR relative to the single, isolated node performance.

Figure 16:
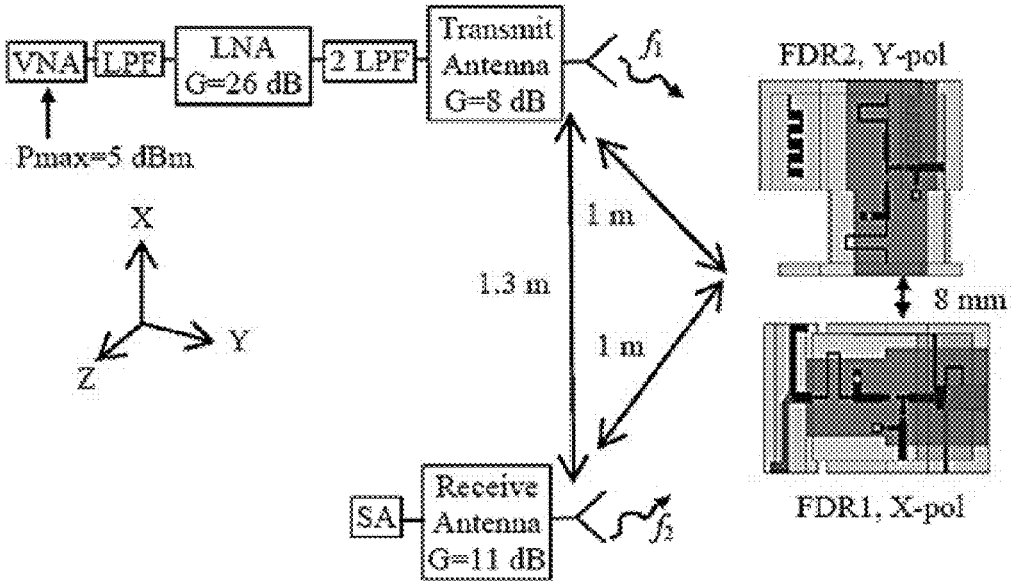
FIG. 16 is a block diagram of a measurement setup that was used to characterize repeater performance, perform a range measurement test, and perform a remote calibration.

The measurement setup used to perform the remote calibration is shown in FIG. 16. Low pass filters (LPFs) were used to prevent transmission of the second harmonic of the VNA-generated interrogation signal. The transmit and receive interrogator antennas were linearly polarized and were rotated to interrogate either FDR1 (sensor node) or FDR2 (reference node).

Figure 17:
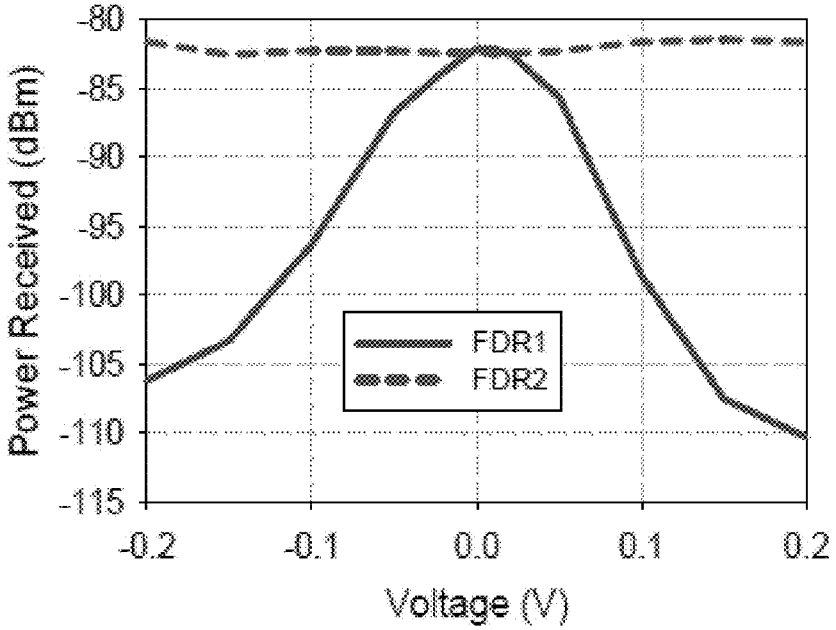
FIG. 17 is a graph of a measured received power level versus bias voltage at −30 dBm input power and $f_1$ of 2.4 GHz for a repeater prototype.

FIG. 17 shows the measured return signal power level from the two FDRs for different bias voltages applied to FDR1. The test was conducted in an anechoic environment to illustrate the ability of the approach to provide a channel calibration. As expected, FDR2 provided a stable reference signal level that changed by less than 1 dB whereas FDR1's return varied greater than 20 dB as the bias on FDR1 changed. In practice (i.e., when sensors are deployed in the field), the FDR2 response would be subtracted from the measured FDR1 response to provide a calibrated sensor reading.

The above-described remote calibration approach is of practical value for different sensing scenarios. When using sensors that provide an absolute measure of a potentially slowly varying stimulus, such as temperature, the calibration process can involve the use of a reference signal that sets a constant baseline level against which the signal from the sensor node is compared. For sensors providing a relative measure of a stimulus that may change relatively fast over time, such as vibration, the constant calibration signal can be used to locate the node and ensure it is physically intact.

As described above, one goal is to minimize the size of the repeater. This size can be reduced by removing the portions of the substrates that are not needed to support the antennas or other electrical features of the repeater. In some embodiments, the substrates can be machined to remove these portions. With such an approach, it is possible to fit the repeater within a sphere having a diameter of approximately 21 mm, which is equal to $\lambda_1/6$, which constitutes a 32% size reduction relative to the embodiment shown in FIG. 2. Despite the size reduction, such a repeater can operate with an overall conversion efficiency of greater than −15 dB for an RF input power level range between −20 to −30 dBm and exhibit omni-directional interrogation capability.

Figure 18A:
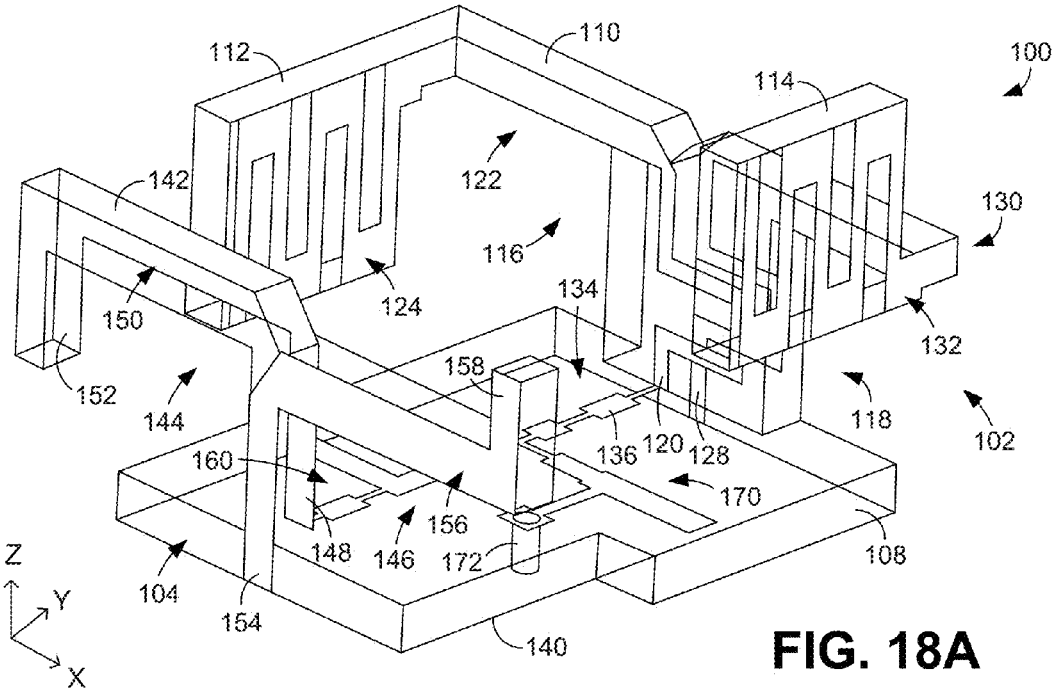
FIG. 18A is a perspective view of an alternative embodiment of a repeater comprising a receive antenna, a transmit antenna, and a frequency multiplier.
Figure 18B:
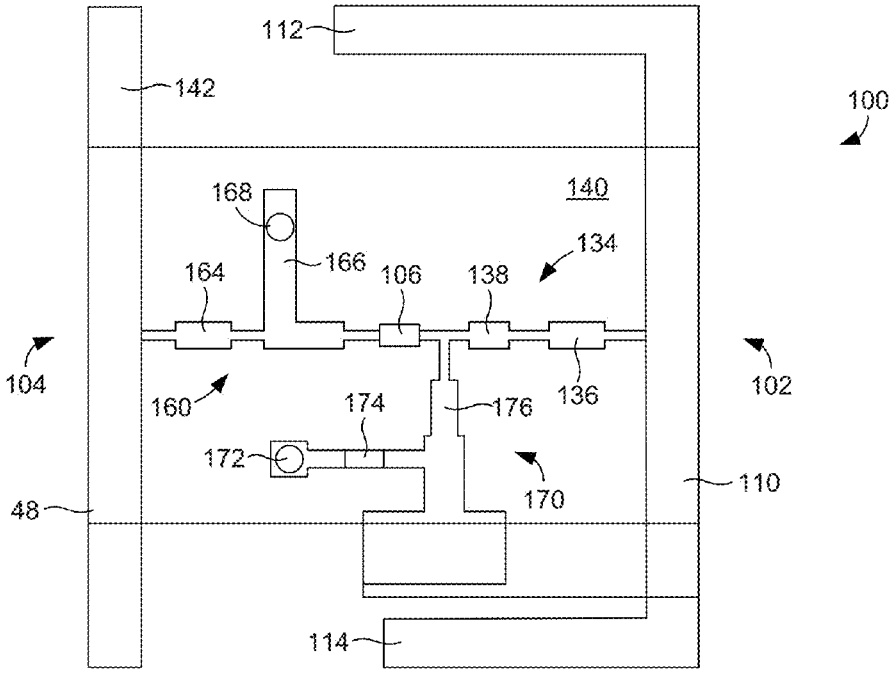
FIG. 18B is a top view of the repeater of FIG. 18A.

FIGS. 18A and 18B illustrate an example repeater 100 having machined substrates. As indicated in these figures, the repeater 100 has a configuration similar to the repeater 10 described above. Therefore, the repeater 100 generally comprises a receive antenna 102 and a transmit antenna 104 that are coupled by a frequency multiplier 106, which can comprise a Schottky barrier diode. The receive antenna 102 is a three-dimensional half-wave dipole antenna and is formed on multiple substrates that together form part of the cubic structure of the repeater 100. The substrates include a base substrate 108, a front substrate 110, and opposed first and second lateral substrates 112 and 114.

The receive antenna 102 comprises two separate antenna elements that together form the dipole, including a first antenna element 116 and a second antenna element 118. The first antenna element 116 includes a vertical portion 120 that extends upward from the base substrate 108 along the inner surface of the front substrate 110 and an arm 122 that extends laterally from a top end of the vertical portion. The arm 122 extends horizontally along the inner surfaces of both the front substrate 110 and the first lateral substrate 112. Provided at a distal end of the arm 122 on the inner surface of the first lateral substrate 112 is a meandered portion 124 that extends downward from the distal end of the arm.

The second antenna element 118 of the receive antenna 12 is anti-symmetrical to the first antenna element 116 and comprises a vertical portion 128 that extends upward from the base substrate 108 along the outer surface of the front substrate 110. The second antenna element 118 also comprises an arm 130 that extends outward from a top end of the vertical portion 128. That arm 130 extends horizontally along the outer surface of both the front substrate 110 and the second lateral substrate 114. Provided at a distal end of the arm 130 on the outer surface of the second lateral substrate 114 is a further meandered portion 132. As shown in FIG. 18A, however, the meandered portion 132 of the second antenna element 118 extends upward from the distal end of the arm 130.

The first antenna element 116 is coupled to a feeding network 134 that includes a microstrip matching line having an inductor 136 and a 50Ω microstrip line 138, which are both formed on the inner surface of the base substrate 108. The second antenna element 118 is coupled to a ground plane 140 that is formed on the outer (bottom) surface of the base substrate 108.

The transmit antenna 104 is also a three-dimensional half-wave dipole antenna and is formed on the base substrate 108 and a rear substrate 142. As shown in FIG. 18A, the transmit antenna 104 also comprises a first antenna element 144 and a second antenna element 146. The first antenna element 144 includes a vertical portion 148 that extends upward from the base substrate 108 along the inner surface of the rear substrate 142 and an arm 150 that extends laterally from a top end of the vertical portion. The arm 150 extends horizontally along the inner surface of the rear substrate 142 and terminates in a downwardly extending vertical portion 152. The second antenna element 146 is anti-symmetrical to the first antenna element 142 and comprises a vertical portion 154 that extends upward from the base substrate 108 along the outer surface of the rear substrate 142 and an arm 156 that extends laterally from a top end of the vertical portion. The arm 156 extends horizontally along the outer surface of the rear substrate 142 and terminates in an upwardly extending vertical portion 158.

As is further shown in FIG. 18A, the second antenna element 146 is coupled to the ground plane 140 that is formed on the outer (bottom) surface of the base substrate 108, while the first antenna element 144 is coupled to a feeding network 160 that is formed on the inner surface of the base substrate. As shown best in FIG. 18B, the feeding network 160 includes a microstrip matching line having a further inductor 164 and a shunt stub 166 that connects to the ground plane 140 with a via hole 168.

As is further illustrated in FIG. 18B, the repeater 100 also comprises a DC bias network 170 that is coupled to the feeding network 134 of the receive antenna 102. The bias network 170 can be used to connect a sensor to the repeater 100 so that the signal received by the repeater during interrogation can be modulated by the sensor to provide an indication of the sensed parameter. In the illustrated embodiment, the bias network 170 includes a via hole 172 that connects to the ground plane 140, a capacitor 174, and an RF choke 176.

Unlike the substrates of the repeater 10, the substrates of the repeater 100 have been machined to remove unneeded material. As indicated in FIG. 18, most of the base substrate 108, front substrate 110, lateral substrates 112 and 114, and rear substrate 142 that do not support an electrical element have been machined away. FIG. 19 illustrates the significant benefits of applying this machined substrate approach on the transceiver performance. The approach enables the use of high dielectric constant materials in strategic locations to minimize the antenna size without degrading the overall node performance. In particular, proximity effects between the closely spaced antennas and diffraction that occurs at the substrate edges are both mitigated, which helps to minimize pattern tilt and gain variation over the antenna H-plane. The removal of material also reduces dielectric loss, which improves radiation efficiency. Comparing the performance between the unmachined embodiment (FIG. 2) to the machined embodiment (FIG. 18) shows that the pattern distortion is reduced by 6 dB and the radiation efficiency of the transmit antenna is increased by approximately 20%. Pattern distortion is of great importance for embedded sensing applications as it is equivalent to misalignment between the interrogator and sensor node antennas, and will therefore limit the communications range.

A repeater similar to that shown in FIGS. 18A and 18B was constructed to validate its performance. Measurements were performed inside an anechoic chamber, where the transceiver receives the $f_1$ signal and transmits a return signal at $f_2$. A VNA was used to send the transmitted signal and a spectrum analyzer was used for measuring the received signal power level. The interrogator transmit and receive antennas were placed 1 m from the node and separated by 1.5 m.

Figure 20A:
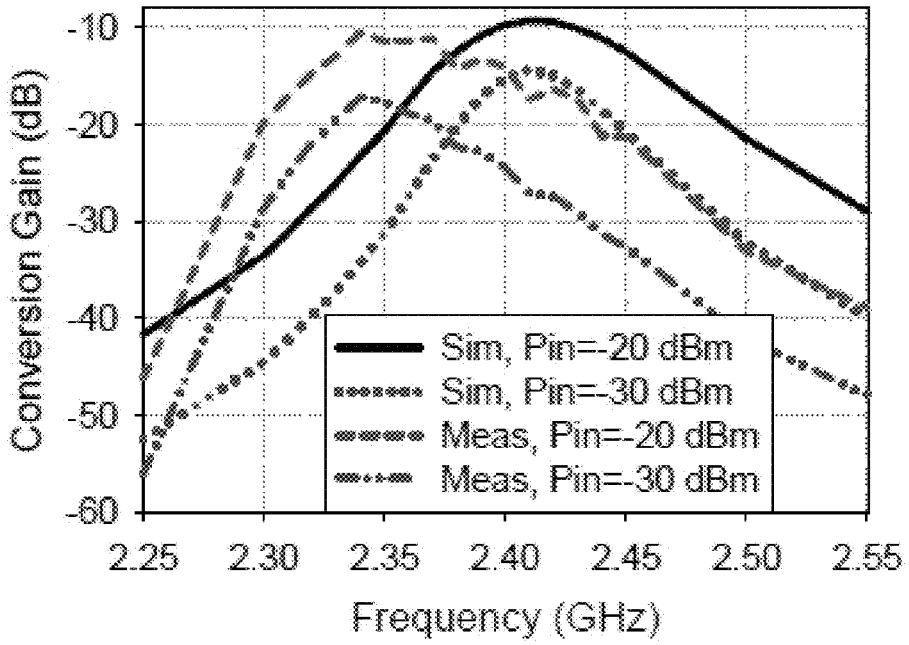
FIGS. 20A and 20B are graphs that show the CG versus frequency for different received powers (20A) and the CG versus input power for different $f_1$ (20B).
Figure 20B:
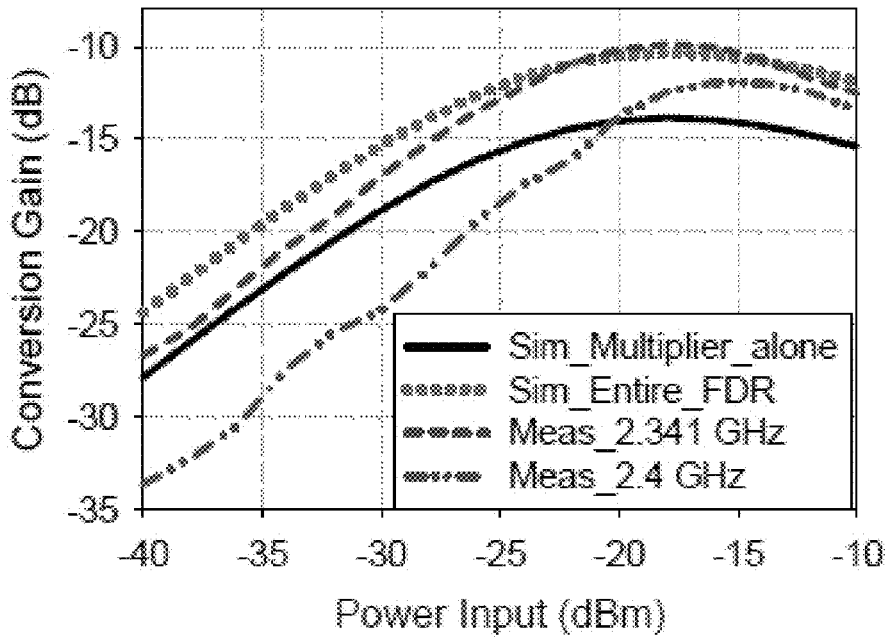

FIGS. 20A and 20B illustrate the measured and simulated CG performance for different interrogation signal frequencies (20A) and different input power levels (20B). The CG is defined here as the ratio between the output power of the transceiver at $f_2$ and the input power at $f_1$, including the antenna gains. The simulated CG of the transceiver was calculated by adding 3.5 dB (the sum of antenna peak gains) to the simulated CG curve of the multiplier alone. As shown in FIG. 20A, the maximum CG value occurred at 2.341 GHz and closely matched the predicted results. This shift from the 2.4 GHz design frequency is attributed to fabrication and assembly errors. The measured CG 3 dB bandwidth was 2.5% and 1.8% at input powers of −20 dBm and −30 dBm, respectively. The CG dependence on the received power was due to the non-linear diode impedance.

Figure 21:
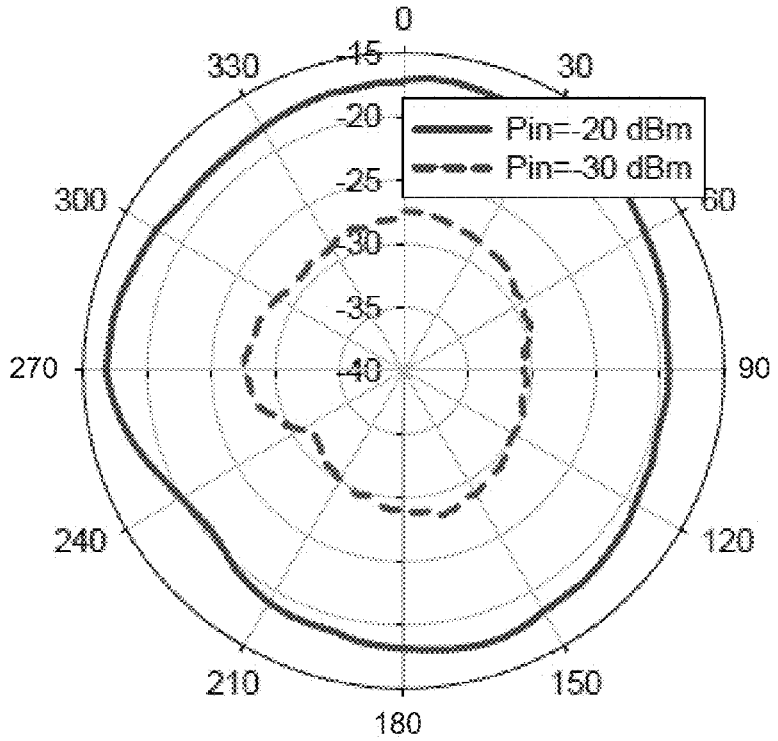
FIG. 21 is a graph that shows the measured CG (dB) versus incidence angle (YZ-plane, FIG. 18).

FIG. 21 shows the measured CG over different angles of incidence and for different received power levels. In this measurement, the transceiver was rotated around the H-plane of the antennas (Y-Z plane relative to FIG. 18). The measured variation in CG for received powers of −20 and −30 dBm is 3.6 and 4 dB, respectively. Table IV compares the presented transceiver design with other harmonic transceivers in terms of electrical size, maximum CG, and operating power. As shown in the table, the disclosed design gives better overall performance.

TABLE IV

COMPARISON OF THE CG AND ELECTRICAL SIZE WITH OTHER DESIGNS FROM THE LITERATURE

| Parameter | Max CG (dB) | RF Power (dBm) | Size (λ) | $f_1$ (GHz) |
|---|---|---|---|---|
| Presented Design | −9.8 | −18 | 0.16 | 2.4 |
| [27] | −8.4 | −20 | 0.24 | 2.4 |
| [32] | −19.7 | −15 | 0.25 | 1.3 |
| [33] | −35.4 | −19.5 | 0.24 | 1.3 |
| [23] | −11 | −41 | 0.265 | 5.9 |

Experiments were performed to detect vibration using a sensor node that comprised a repeater similar to that shown in FIGS. 18A and 18B and a vibration sensor that was coupled to the repeater. The experiments were performed inside an anechoic chamber where the sensor node was interrogated by a signal generated using a VNA and the return signal is measured using a spectrum analyzer (SA) in the zero-span mode. Low-pass filters were added in the transmit path to filter out the VNA-generated harmonics. While the sensor node was being interrogated, a Labworks shaker was excited with a function generator to drive the sensor into vibration. Because of mechanical configuration constraints (primarily the size of the shaker) the sensor was soldered onto a circuit board and connected to the transceiver through copper wires, rather than being directly connected within the transceiver during the vibration testing.

Figure 22:
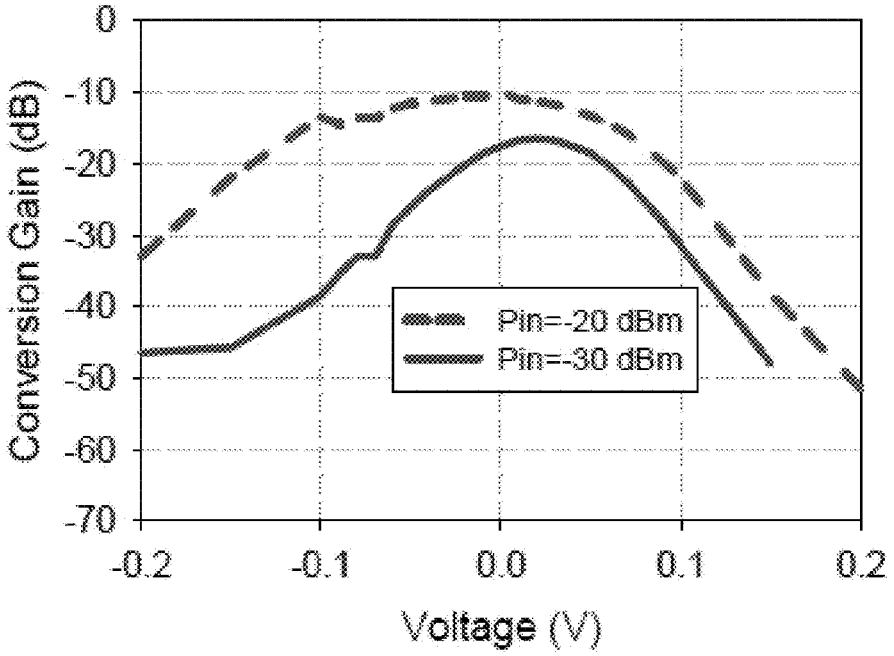
FIG. 22 is a graph that shows the measured CG versus DC voltage for different RF input power.

It was found in prior work that, by applying DC voltage to the diode doubler input, amplitude modulation can be imparted to the return signal. The voltage changes the diode impedance match with the antennas thus changing the CG of the transceiver. To test the capability to modulate the return signal, the CG was measured for different applied DC voltages and different power levels. As shown in FIG. 22, the CG was very sensitive to the applied voltage, as a 0.1 V bias decreases the CG by >14 dB. Thus, using a passive sensor that can generate voltage, such as the piezoelectric sensors, will provide amplitude modulation.

Figure 23A:
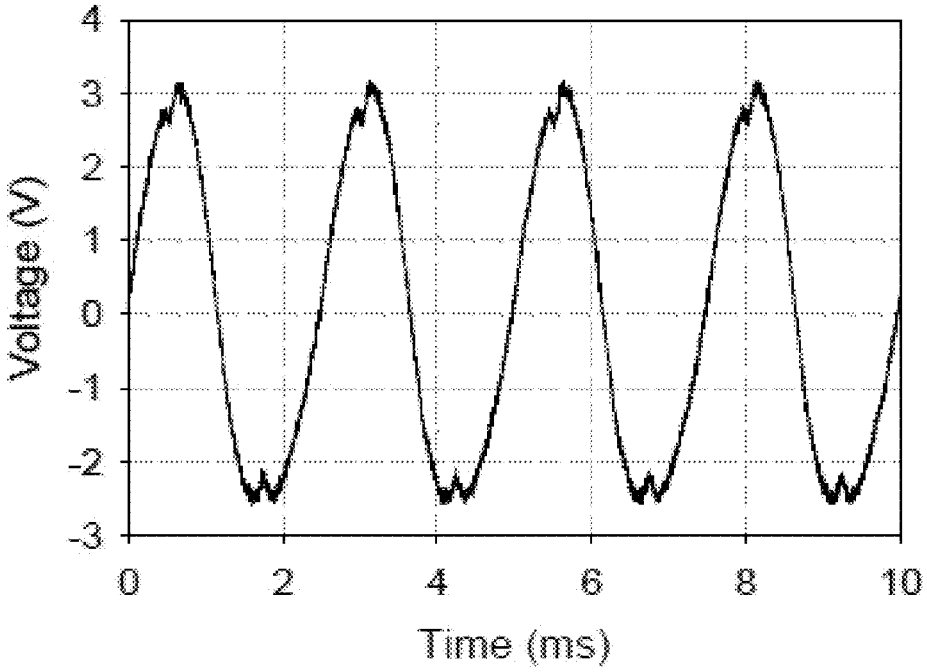
FIGS. 23A and 23B are graphs that show the piezoelectric sensor output voltage versus time as measured using an oscilloscope (23A) and the measured transceiver return signal level at $2*f_1$ with the piezoelectric sensor connected to the doubler input (23B).
Figure 23B:
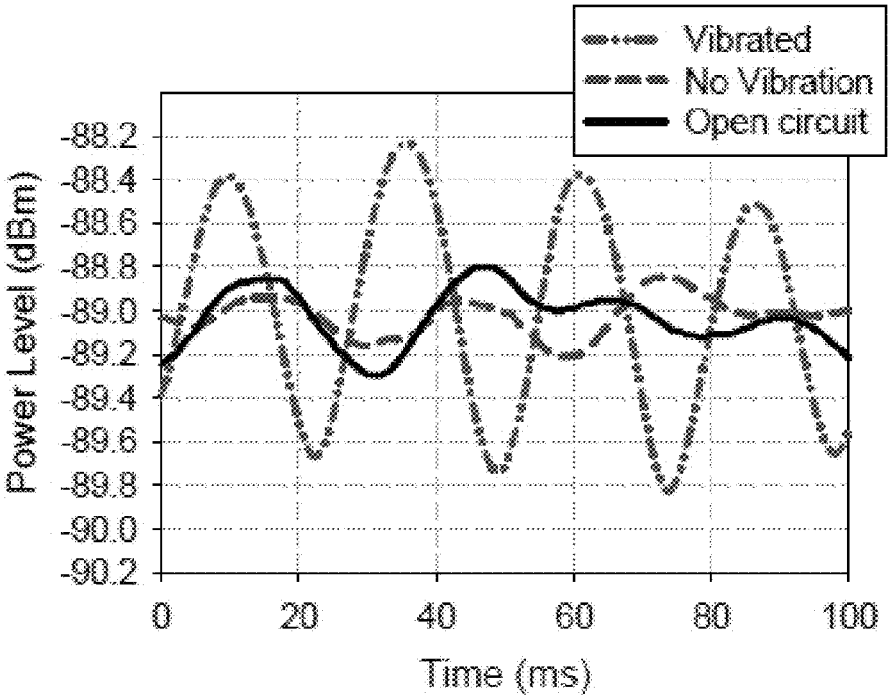

A piezoelectric thin-film vibration sensor (MiniSense 100 from Measurement Specialties) was used during the testing and was excited at a vibration frequency of 40 Hz and amplitude of 9 g (deflection of 2.5 mm). The output voltage waveform from the sensor was measured using an oscilloscope with a load impedance of 1 M Ω. The voltage waveform is illustrated in FIG. 23A. As shown in the figure, the peak voltage was ~3 V and the measured frequency was approximately 40 Hz. FIG. 23B illustrates the return signal power level from the node versus time for a received RF power level of −30 dBm. The return power was approximately the same when the DC network is open-circuited and when the sensor was attached but is not driven into vibration. However, when the sensor vibrated, the return power had a peak to peak variation of approximately 1 dB and a frequency of approximately 40 Hz. Based on the data of FIG. 22, the voltage across the doubler that causes this power level reduction is approximately 10 mV. The difference in the oscilloscope impedance and the doubler impedance (−2.2 K Ω) was the reason for the drop from 3 V to 10 mV, since the capacitive input (~500 pF) of the sensor combines with the load resistance to create a high pass filter.

Additional testing was performed to ensure that the integration of the piezoelectric sensor with the transceiver would not produce adverse proximity effects. The sensor was attached inside the repeater structure (i.e., within the cube defined by the repeater) and no degradation in the CG was observed. However, placing this sensor inside the node restricted the fluctuation of the sensor cantilever film that would reduce the generated voltage. In order to increase the voltage delivered to the doubler at a given vibration level, enabling lower vibration frequencies and amplitudes to be detected more easily, the sensor can be designed to have a larger capacitive input.

For the structural health monitoring applications, the vibration frequency and amplitude are both usually very low. Although piezoelectric thin-film sensors are suitable for detecting high frequency stimuli, it was found through analysis and experimental results that mechanical switches can be effectively used to provide low vibration frequency and low amplitude detection capability. The sensors used in the demonstration were the CM1344-1, AG2401-1, and ASLS-2 from Comus International. These sensors offer the additional benefit of being hermitically sealed for long lifetime operation.

Figure 24:
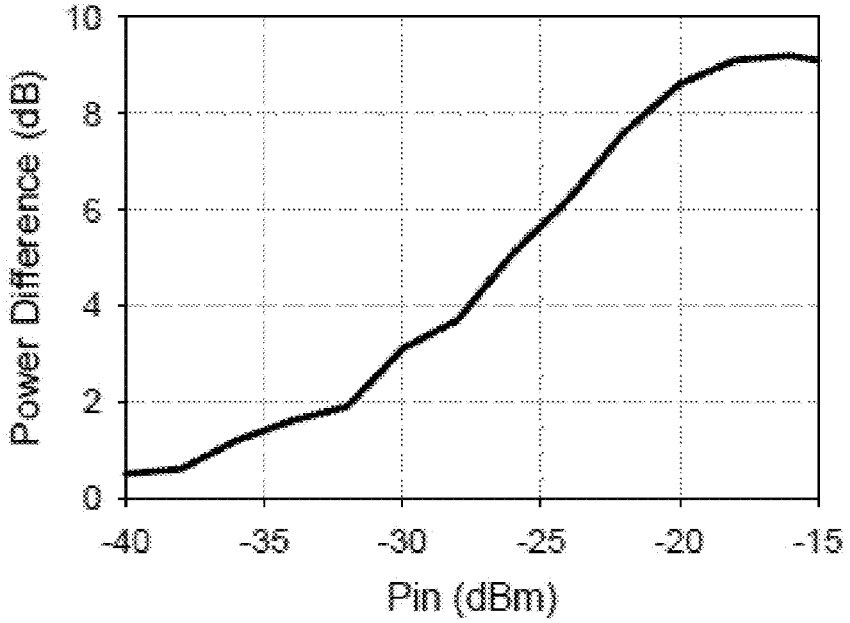
FIG. 24 is a graph that shows the measured return power difference at $f_1$ of 2.341 GHz when the DC return path is switched between open and closed states.

The mechanical switches can be integrated into the sensor node in different manners to impart modulation to the return signal. In some embodiments, the switch can be used to open and close the diode DC current return path at the doubler input. This approach decouples the mechanical switch from the RF path, thereby alleviating the need to accurately model switch behavior at microwave frequencies and providing a more controlled transceiver response. As seen appreciated from FIG. 24, opening and closing the DC current path causes the return signal to vary between 3.1-8.5 dB for an RF input power of −30 to −20 dBm. This behavior avoids extreme "on/off" characteristics regardless of the normal or resting state of the mechanical switch and could be advantageous when communications with the node are needed even if it is not vibrating. For example, the node can provide a reference signal to calibrate the propagation channel for other nearby sensors, determine the sensor location, or be used for identification.

The AG2401-1 sensor is a low-cost ball switch that has the ability to detect very low vibration frequencies and amplitudes. Depending on its position and orientation, this sensor can rest in the open or closed state and, once it is driven into vibration, it continually changes its state as long as the motion continues. When it is in the closed state, the contact resistance is less than 1Ω. The sensor's cylindrical case has a diameter of 4 mm and height of 4.5 mm.

In order to detect stronger shocks, as might be excited by an earthquake, the ASLS-2 spring-damped ball switch proved to be effective. This switch needs to be driven by vibration amplitudes between 2-4.9 g in order to change its state. Unlike the AG2401-1 sensor, the ASLS-2 sensor responds only when the vibration waveform is above or below the zero state and not to both positive and negative excursions.

A similarly-sized mercury switch, model CM1344-1, was also tested with the sensor node. This class of switches has a longer operating lifetime than ball switches, and a higher cost. The mercury switch also offers the additional benefit of being responsive to vibration along any axis and may therefore be advantageous for embedded sensing applications where the orientation of the deployed sensor nodes is difficult to control. This switch is normally in the open state and when it is subjected to vibration it intermittently changes its state near the peaks of the excitation wave. Experimental testing with this switch showed that vibration frequencies from 3-40 Hz were detectable, although when the frequency is greater than 10 Hz the vibration frequency is difficult to correlate with the excitation signal frequency.

In some embodiments, the sensor node can simultaneously house multiple sensors without considerable performance degradation. In many situations it is desirable to use a single sensor node for different concurrent applications, thus reducing the size, cost, and identification complexity. Because the AG2401-1 and the ASLS-2 switch sensors change state only when the vibration is within specific non-overlapping amplitude and frequency ranges, they can be integrated in parallel giving the capability of detecting low and high amplitude acceleration. The sensor node was simulated and tested with those mechanical switches in place and no performance sensitivity was observed. In order to have the sensors oriented to be normally in the open state, a specific node orientation might be required. This limitation can be overcome by integrating the sensors in a different topology or using other sensor candidates.

Figure 25:
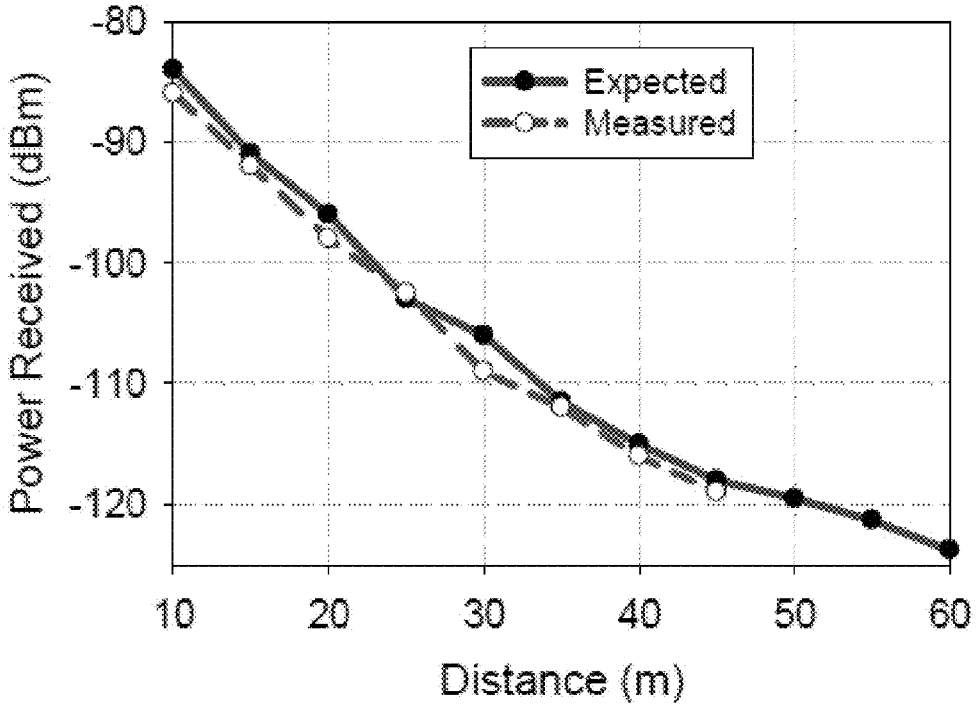
FIG. 25 is a graph that shows the received return signal strength versus distance using a 43 dBm EIRP transmitter and 10 dB gain receiver.

FIG. 25 shows the return signal level versus interrogation distance using a 43 dBm EIRP (effective isotropic radiated power) transmitter and 10 dB gain receiver. The expected power level was calculated based on the CG measurement performed inside the anechoic chamber (FIG. 20B) and assuming a free space line-of-sight communication link. Assuming that the lowest received signal level that can be detected is −125 dBm, the transceiver range was found to be approximately 60 m. In order to verify the expected range, outdoor measurements were performed. During measurement the interrogator antennas and transceiver were placed at a height of approximately 1.5 m above the ground and oriented where the maximum CG value was recorded. The range was measured by varying the interrogator-transceiver distance and tracking the return signal level for a fixed transmitted power. The measurement was performed over distances range between 10 to 45 m. As seen in FIG. 25, the measured and expected data are well matched. This experiment reveals that when using the harmonic radar approach under these conditions, the communication range is mainly limited by the level of the transmitted power.

The invention claimed is:

1. A repeater for wireless sensing, the repeater comprising:

a base substrate;

a front substrate orthogonal to the base substrate;

a rear substrate orthogonal to the base substrate;

a receive antenna formed on the front substrate configured to receive an interrogation signal transmitted by another device;

a bias network configured to connect the repeater to a sensor and modulate the interrogation signal based upon a parameter sensed by the sensor;

a frequency multiplier formed on the base substrate, the frequency multiplier being in communication with the receive antenna and configured to multiply the frequency of the interrogation signal by a multiplication factor; and a transmit antenna formed on the rear substrate, the transmit antenna being in communication with the frequency multiplier and configured to retransmit the modulated interrogation signal at a multiplied frequency.

2. The repeater of claim 1, wherein the receive antenna is a three-dimensional half-wave dipole antenna that comprises a first antenna element and a second antenna element, the first antenna element including a vertical portion formed on one side of the front substrate and the second antenna element including a vertical portion formed on the opposite side of the front substrate.

3. The repeater of claim 2, wherein each antenna element of the receive antenna further comprises a dipole arm that extends laterally from its vertical portion.

4. The repeater of claim 3, further comprising first and second lateral substrates that are orthogonal to the front substrate, wherein each dipole arm extends onto one of the lateral substrates.

5. The repeater of claim 4 . . . , wherein the dipole arms each terminate in a meandered portion and are anti-symmetrical to each other.

6. The repeater of claim 1, wherein the transmit antenna is a three-dimensional half-wave dipole antenna that comprises a first antenna element and a second antenna element, the first antenna element including a vertical portion that is formed on one side of the rear substrate and the second antenna element including a vertical portion that is formed on the opposite side of the rear substrate.

7. The repeater of claim 6, wherein each antenna element of the transmit antenna further comprises a dipole arm that extends laterally from its vertical portion.

8. The repeater of claim 7, wherein the dipole arms each terminate in a vertical portion and are anti-symmetrical to each other.

9. The repeater of claim 1, wherein the frequency multiplier is configured to double the frequency of the interrogation signal received by the receive antenna such that the retransmitted interrogation signal has a frequency that is twice the frequency of the received interrogation signal.

10. The repeater of claim 1, wherein the frequency multiplier comprises a Schottky barrier diode.

11. The repeater of claim 1, further comprising a first feeding network formed on the base substrate that connects the receive antenna to the frequency multiplier and a second feeding network formed on the base substrate that connects the transmit antenna to the frequency multiplier.

12. The repeater of claim 11, wherein the feeding networks are formed on a first side of the base substrate and the repeater further comprises a ground plane that is formed on an opposite side of the base substrate, wherein the receive and transmit antennas are connected to the ground plane.

13. The repeater of claim 1, wherein the front substrate and the rear substrate have been machined to remove excess material.

14. The repeater of claim 13, wherein the portions of the front and rear substrates that do not support an electrical element have been machined away.

15. The repeater of claim 1, wherein the bias network comprises a direct current bias network.

16. The repeater of claim 11, wherein the bias network is coupled to the first feeding network.

17. A repeater for wireless sensing, the repeater comprising:

a base substrate;

a front substrate that is orthogonal to the base substrate;

first and second lateral substrates that are orthogonal to the front substrate;

a rear substrate that is orthogonal to the base substrate;

a receive antenna including a first antenna element and a second element, the first antenna element including a vertical portion formed on an inner side of the front substrate and a dipole arm that extends laterally outward from the vertical portion across the inner side and onto the first lateral substrate, the second antenna element including a vertical portion formed on an outer side of the front substrate and a dipole arm that extends laterally outward from the vertical portion across the outer side and onto the second lateral substrate;

a transmit antenna including a first antenna element and a second element, the first antenna element including a vertical portion formed on an inner side of the rear substrate and a dipole arm that extends laterally outward from the vertical portion across the inner side, the second antenna element including a vertical portion formed on an outer side of the rear substrate and a dipole arm that extends laterally outward from the vertical portion across the outer side;

a frequency multiplier provided on the base substrate;

a first feeding network formed on the base substrate that connects the first antenna element of the receive antenna to the frequency multiplier; and a second feeding network formed on the base substrate that connects the first antenna element of the transmit antenna to the frequency multiplier.

18. The repeater of claim 17, wherein the dipole arms of the receive antenna each terminate in a meandered portion and the dipole arms of the transmit antenna each terminate in a vertical portion.

19. The repeater of claim 18, wherein the dipole arms of each antenna are anti-symmetrical to each other.

20. The repeater of claim 17, wherein the front substrate and the rear substrate have been machined to remove the portions of the front and rear substrates that do not support an electrical element have been machined away.

* * * * *